US007635120B2

(12) United States Patent
Awano

(10) Patent No.: US 7,635,120 B2
(45) Date of Patent: Dec. 22, 2009

(54) BOOKLET FINISHING APPARATUS, POST-TREATMENT APPARATUS AND IMAGE FORMING SYSTEM

(75) Inventor: Hiroaki Awano, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 162 days.

(21) Appl. No.: 11/452,306

(22) Filed: Jun. 14, 2006

(65) Prior Publication Data

US 2007/0098525 A1 May 3, 2007

(30) Foreign Application Priority Data

Oct. 31, 2005 (JP) ..... 2005-316989
Nov. 18, 2005 (JP) ..... 2005-334100
Nov. 25, 2005 (JP) ..... 2005-339792

(51) Int. Cl.
*B65H 37/04* (2006.01)

(52) U.S. Cl. ..... 270/37; 270/58.07; 270/58.08; 270/58.09

(58) Field of Classification Search ..... 270/37, 270/58.07, 58.08, 58.09; 412/22, 30
See application file for complete search history.

(56) References Cited

U.S. PATENT DOCUMENTS 6,692,208 B1 * 2/2004 Watkiss et al. ..... 412/1
7,374,160 B2 * 5/2008 Doi ..... 270/37
2005/0008460 A1 * 1/2005 Watkiss ..... 412/9
2005/0191154 A1 * 9/2005 Fujimoto et al. ..... 412/1
2006/0027959 A1 * 2/2006 Doi ..... 270/37

FOREIGN PATENT DOCUMENTS

| | | |
|---|---|---|
| JP | 2001-260564 | 9/2001 |
| JP | 2004-168012 | 6/2004 |
| JP | 2004-196524 | 7/2004 |
| JP | 2004-209886 | 7/2004 |
| JP | 2004-210436 | 7/2004 |
| JP | 2004-345863 | 12/2004 |

* cited by examiner

*Primary Examiner*—Gene Crawford
*Assistant Examiner*—Leslie A Nicholson, III
(74) *Attorney, Agent, or Firm*—Morgan, Lewis & Bockius LLP

(57) ABSTRACT

A booklet finishing apparatus has a clamping unit that flattens a booklet of folded sheets by clamping at least on portion adjacent to a back of the booklet from both surfaces of the booklet, a forming unit that flattens the back of the booklet by pressing the back of the booklet, and a switching unit that has a plurality of modes to control the forming unit and switches between the plurality of modes.

9 Claims, 24 Drawing Sheets

| | | Saddle stitching | | | | Without saddle stitching | | | |
|---|---|---|---|---|---|---|---|---|---|
| | | Without cover or 80 >= x >= 64 gsm | With cover104 >= x > 80 gsm | With cover 128 >= x > 104 gsm | With cover 158 >= x > 128 gsm | Without cover or 80 >= x >= 64 gsm | With cover 104 >= x > 80 gsm | With cover 128 >= x > 104 gsm | With cover 158 >= x > 128 gsm |
| Content sheet thickness 80 >= x >= 64 gsm | The number of content sheets: 3 or less | Perform only first process | Perform only first process | Perform only first process | Perform only first process | Perform only first process | Perform only first process | Perform only first process | Perform only first process |
| | The number of content sheets: 4 | Perform only first process | Perform only first process | Perform only first process | Perform only first process | Perform only first process | Perform only first process | Perform only first process | Perform only first process |
| | The number of content sheets: 5 | Perform only first process | Perform only first process | Perform only first process | Perform only first process | Perform only first process | Perform only first process | Perform only first process | Perform only first process |
| | The number of content sheets: 6 | Perform only first process | Perform only first process | Perform all first process | Perform only first process | Perform only first process | Perform only first process | Perform only first process | Perform only first process |
| | The number of content sheets: 7 | Perform all processes | Perform all processes | Perform all processes | Perform all processes | Prohibit booklet production | Prohibit booklet production | Prohibit booklet production | Prohibit booklet production |
| | The number of content sheets: 8 | Perform all processes | Perform all processes | Perform all processes | Perform all processes | Prohibit booklet production | Prohibit booklet production | Prohibit booklet production | Prohibit booklet production |
| | The number of content sheets: 9 | Perform all processes | Perform all processes | Perform all processes | Perform all processes | Prohibit booklet production | Prohibit booklet production | Prohibit booklet production | Prohibit booklet production |
| | The number of content sheets: 10 | Perform all processes | Perform all processes | Perform all processes | Perform all processes | Prohibit booklet production | Prohibit booklet production | Prohibit booklet production | Prohibit booklet production |
| | The number of content sheets: 15 | Perform all processes | Perform all processes | Perform all processes | Perform all processes | Prohibit booklet production | Prohibit booklet production | Prohibit booklet production | Prohibit booklet production |
| Content sheet thickness 104 >= x > 80gsm | The number of content sheets: 3 or less | Prohibit booklet production | Perform all processes | Perform only first process | Perform only first process | Prohibit booklet production | Perform only first process | Perform only first process | Perform only first process |
| | The number of content sheets: 4 | Prohibit booklet production | Perform only first process | Perform only first process | Perform only first process | Prohibit booklet production | Perform only first process | Prohibit booklet production | Perform only first process |
| | The number of content sheets: 5 | Prohibit booklet production | Perform all processes | Perform all processes | Perform all processes | Prohibit booklet production | Perform only first process | Prohibit booklet production | Perform only first process |
| | The number of content sheets: 6 | Prohibit booklet production | Perform all processes | Perform all processes | Perform all processes | Prohibit booklet production | Perform only first process | Prohibit booklet production | Perform only first process |
| | The number of content sheets: 7 | Prohibit booklet production | Perform all processes | Perform all processes | Perform all processes | Prohibit booklet production | Prohibit booklet production | Prohibit booklet production | Prohibit booklet production |
| | The number of content sheets: 8 | Prohibit booklet production | Perform all processes | Perform all processes | Perform all processes | Prohibit booklet production | Prohibit booklet production | Prohibit booklet production | Prohibit booklet production |
| | The number of content sheets: 9 | Prohibit booklet production | Perform all processes | Perform all processes | Perform all processes | Prohibit booklet production | Prohibit booklet production | Prohibit booklet production | Prohibit booklet production |
| | The number of content sheets: 10 | Prohibit booklet production | Perform all processes | Perform all processes | Perform all processes | Prohibit booklet production | Prohibit booklet production | Prohibit booklet production | Prohibit booklet production |
| | The number of content sheets: 11 to 15 | Prohibit booklet production | Prohibit booklet production | Prohibit booklet production | Prohibit booklet production | Prohibit booklet production | Prohibit booklet production | Prohibit booklet production | Prohibit booklet production |
| Content sheet thickness 128 >= x > 104 gsm | The number of content sheets: 3 or less | Prohibit booklet production | Prohibit booklet production | Perform only first process | Perform only first process | Prohibit booklet production | Prohibit booklet production | Prohibit booklet production | Perform only first process |
| | The number of content sheets: 4 | Prohibit booklet production | Prohibit booklet production | Perform all processes | Perform all processes | Prohibit booklet production | Prohibit booklet production | Prohibit booklet production | Perform only first process |
| | The number of content sheets: 5 | Prohibit booklet production | Prohibit booklet production | Perform all processes | Perform all processes | Prohibit booklet production | Prohibit booklet production | Prohibit booklet production | Perform only first process |
| | The number of content sheets: 6 | Prohibit booklet production | Prohibit booklet production | Perform all processes | Perform all processes | Prohibit booklet production | Prohibit booklet production | Prohibit booklet production | Perform only first process |
| | The number of content sheets: 7 | Prohibit booklet production | Prohibit booklet production | Perform all processes | Perform all processes | Prohibit booklet production | Prohibit booklet production | Prohibit booklet production | Prohibit booklet production |
| | The number of content sheets: 8 | Prohibit booklet production | Prohibit booklet production | Perform all processes | Perform all processes | Prohibit booklet production | Prohibit booklet production | Prohibit booklet production | Prohibit booklet production |
| | The number of content sheets: 9 | Prohibit booklet production | Prohibit booklet production | Perform all processes | Perform all processes | Prohibit booklet production | Prohibit booklet production | Prohibit booklet production | Prohibit booklet production |
| | The number of content sheets: 10 | Prohibit booklet production | Prohibit booklet production | Perform all processes | Perform all processes | Prohibit booklet production | Prohibit booklet production | Prohibit booklet production | Prohibit booklet production |
| | The number of content sheets: 11 to 15 | Prohibit booklet production | Prohibit booklet production | Prohibit booklet production | Prohibit booklet production | Prohibit booklet production | Prohibit booklet production | Prohibit booklet production | Prohibit booklet production |

Fig. 4

BOOKLET FINISHING APPARATUS, POST-TREATMENT APPARATUS AND IMAGE FORMING SYSTEM

This application claims priority under 35 USC 119 from Japanese patent application Nos. 2005-334100, 2005-316989 and 2005-339792, the disclosure of which is incorporated by reference herein.

BACKGROUND (i) Technical Field

The present invention relates to an image forming system including a post-treatment apparatus that performs post-treatment to a sheet on which an image is formed, and a booklet finishing apparatus that is provided in the post-treatment apparatus and finishes a booklet produced by folding sheets.

(ii) Related Art

Conventionally, a post-treatment apparatus is added to some of image forming systems typified by a printer and a copying machine. The post-treatment apparatus produces the booklet as post-treatment of the sheets in which the images are formed. A method of folding the sheets to produce the booklet can be cited as an example of the booklet producing method. The booklet produced by the method of folding the sheets to produce the booklet has a curvature near a back. Therefore, in order to improve quality of the booklet, a square folding process is employed in which the back of the booklet is compressed to be flat.

FIG. 9 shows an outline of a square folding process.

Part (a) to part (d) of FIG. 9 sequentially show a state in which a square folding process is performed to a booklet 511. As shown in part (a) of FIG. 9, the booklet 511 is produced by folding the sheets. However, because the sheets are not completely folded by being folded only once, the booklet 511 has the curvature near a back 511*a*. As shown in part (b), the booklet 511 is conveyed while the back 511*a* is set at a front end and is positioned by causing the back 511*a* to abut on a stopper 514. A clamping unit 512 clamps the booklet 511 from both surfaces of the booklet 511 to flatten the booklet 511. Then, as shown in part (c), a roller 513 is pressed against the back of the booklet 511*a*. The roller 513 is moved along the back 511*a* while pressing the back 511*a*, and the roller 513 breaks down the back of the booklet 511*a*. Therefore, as shown in part (d), the back of the booklet 511*a* is flattened.

However, in the square folding process, sometimes the booklet quality is decreased depending on the kind of a booklet.

FIG. 10 shows a booklet different from the booklet 511 of FIG. 9.

FIG. 10 shows a state (a) in which the square folding process is performed and a state (b) in which the square folding process is not performed in a relatively thin booklet 521 different from the booklet 511 shown in FIG. 9. In the booklet 521 in the state (a) in which the square folding process is performed, the booklet 521 is relatively flattened compared with the booklet 521 in the state (b), but a projection portion 521*b* which is projected from a cover is formed in a part of the back. For the thin booklet, the square folding process is prohibited by selection of a user so as not to degrade the quality due to the projection portion 521*b*. As a result, although the projection portion 521*b* is not formed, the booklet is left unflattened, which is a problem in terms of finishing quality of the booklet.

Because the number of sheets processed per time is usually kept constant in the image forming apparatus, the number of booklets finished per time is increased as the number of sheets constituting the booklet is decreased. That is, in the case of a relatively thin booklet, a time interval necessary to produce a booklet is probably shorter than a time interval for one-time square folding process. In the case where the folded booklet is not bound, the time interval to produce the booklet is further shortened by the time interval to bind the booklet. In such cases, due to a processing time of the square folding process, a time waiting for the finish of the square folding process is generated on the side of the image forming apparatus or booklet producing unit, which decreases throughput of the whole.

SUMMARY

According to an aspect of the invention, there is provided a booklet finishing apparatus including: a clamping unit that flattens a booklet of folded sheets by clamping at least on portion adjacent to a back of the booklet; a forming unit that flattens the back of the booklet by pressing the back of the booklet; and a switching unit that has a plurality of modes to control the forming unit and switches between the plurality of modes.

BRIEF DESCRIPTION OF THE DRAWINGS

Embodiments of the present invention will be described in detail based on the following figures, wherein;

FIG. 4 is an example of a table showing a relationship between a finishing mode and a thickness, the number of sheets, a size, and presence or absence of booklet binding of sheets constituting a booklet;

DETAILED DESCRIPTION

A booklet finishing apparatus according to an exemplary embodiment of the present invention will be described below with reference to the drawings.

Figure 1:
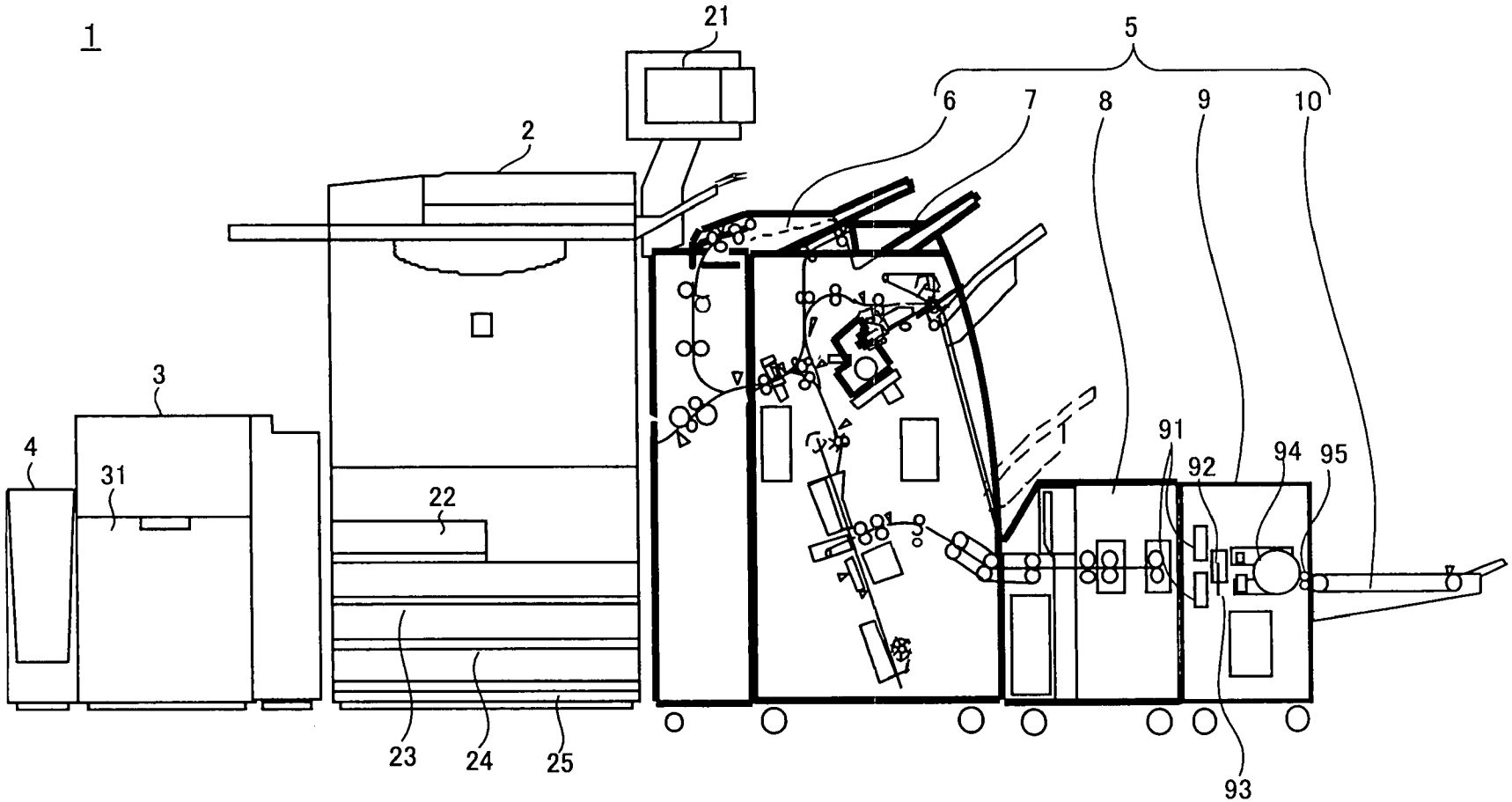
FIG. 1 shows an image forming system into which a booklet finishing apparatus according to a first exemplary embodiment of the invention is incorporated.

FIG. 1 shows an image forming system into which a booklet finishing apparatus according to a first exemplary embodiment of the invention is incorporated.

An image forming system 1 includes an image forming apparatus 2, a post-treatment apparatus 5, a large-capacity sheet feeder 3, and a print server 4. The image forming apparatus 2 forms the image on the sheet, and the post-treatment apparatus 5 performs the post-treatment to the sheet on which the image is formed by the image forming apparatus 2. The large-capacity sheet feeder 3 and the print server 4 are connected to the image forming apparatus 2. The large-capacity sheet feeder 3 has a sheet tray 31 in which a large number of sheets are stored, and the print server 4 assists a printing function of the image forming apparatus 2.

The image forming apparatus 2 is one in which the image is formed in the sheet by an electrophotographic process and the image is conveyed to the post-treatment apparatus 5. The image forming apparatus 2 includes an operation panel 21 and sheet trays 22, 23, 24, and 25. A user inputs information to the image forming apparatus 2 using the operation panel 21. The different kinds of sheets are stored in the sheet trays 22, 23, 24, and 25 respectively.

The post-treatment apparatus 5 includes an inserter 6, a booklet producing unit 7, a trimming machine 8, a square folding device 9, and a stacker 10. The inserter 6 stores the sheets therein to additionally insert the sheet as a cover of the booklet. The booklet producing unit 7 binds the sheets to perform saddle stitching, and the booklet producing unit 7 folds the sheets to produce the booklet. The trimming machine 8 cuts and aligns sides of the booklets. The square folding device 9 that serves as an example of a booklet finishing apparatus performs the finishing of the booklet. The booklets are loaded on the stacker 10. The booklet produced by the booklet producing unit 7 is conveyed through the insides of the trimming machine 8 and the square folding device 9 onto the stacker 10 while the back of the booklet is set at a front end.

The square folding device 9 is one, which performs the finishing of the booklet. The square folding device 9 includes a stop plate 92, a clamping jaw 91, a roller 93, a punch 94, and a carry-out roller 95. The stop plate 92 positions the booklet. The clamping jaw 91 clamps the booklet. The roller 93 flattens the back of the booklet. The punch 94 makes a hole in the booklet. The carry-out roller 95 carries out the booklet to the stacker 10.

The stop plate 92 is a member having a surface on which the booklet abuts. The stop plate 92 can be moved between a position where the stop plate 92 closes a conveyance path of the booklet and a position where the stop plate 92 is retracted from the conveyance path. When the stop plate 92 is located at the position where the stop plate 92 closes the conveyance path of the booklet, the booklet, which is conveyed from the trimming machine 8 to the square folding device 9 with the back of the booklet set as the front end, is positioned by causing the back of the book let to about on the stop plate 92. The clamping jaw 91 has a pair of members which clamp the booklet positioned by the stop plate 92. When the stop plate 92 is located at the position where the stop plate 92 closes the conveyance path of the booklet, the stop plate 92 is arranged with a gap between the stop plate 92 and the clamping jaw 91. Therefore, when the clamping jaw 91 clamps the booklet positioned by the stop plate 92, the back of the booklet is slightly projected from the clamping jaw 91. That is, the clamping jaw 91 clamps booklet portions close to the back of the booklet, so that the booklet portions become flattened. The roller 93 is attached so as to be movable along the back of the booklet clamped by the clamping jaw 91. The roller 93 is moved while pressing the back of the booklet with force enough to press the back, so that the back of the booklet is pressed and flattened by the roller 93. The clamping jaw 91 clamps the booklet during the roller 93 breaks down the back of the booklet.

Figure 2:
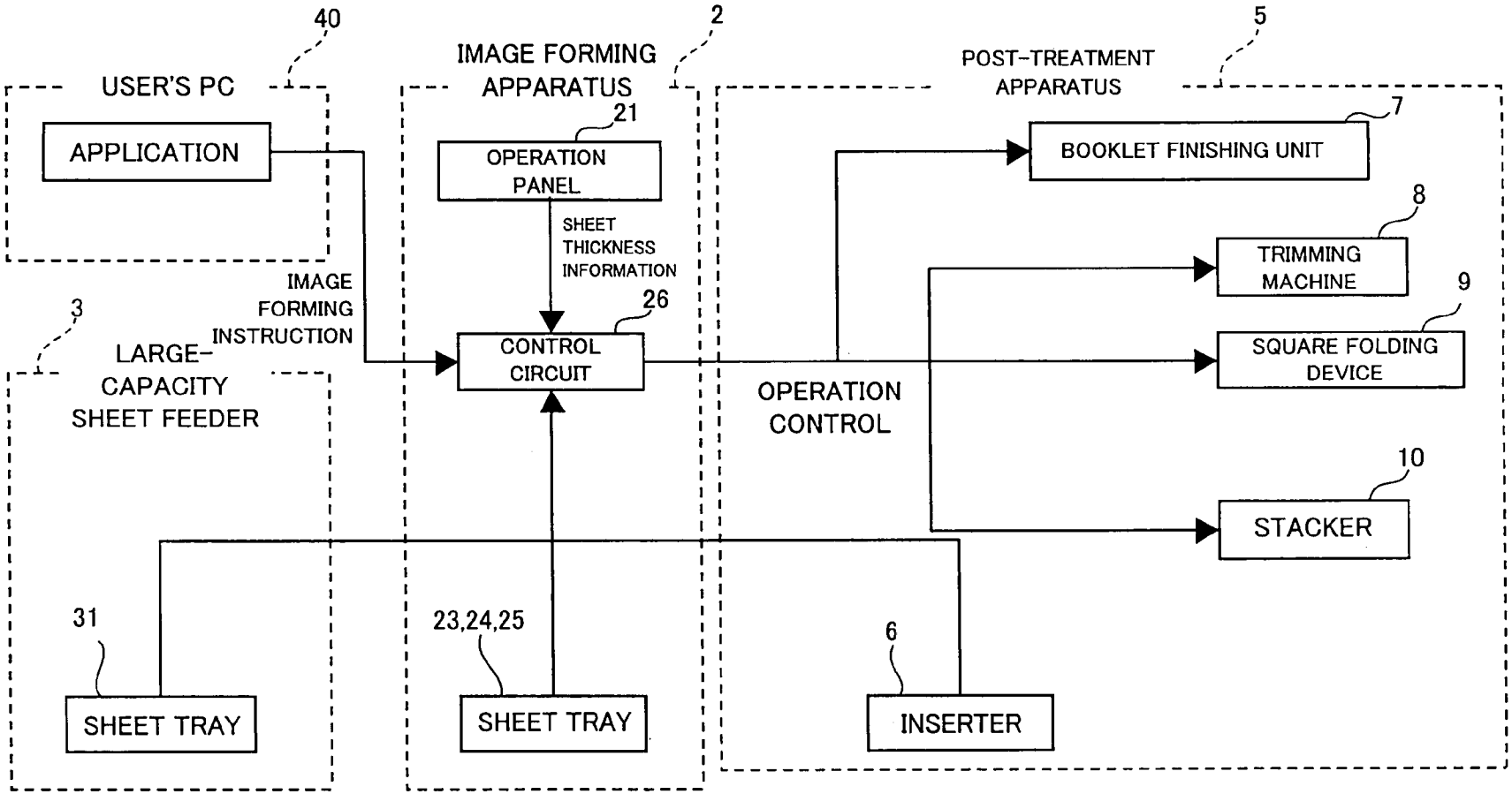
FIG. 2 is a block diagram showing an electric configuration of the image forming system of FIG. 1.

FIG. 2 is a block diagram showing an electric configuration of the image forming system of FIG. 1.

The image forming apparatus 2 includes a control circuit 26, which controls the operation of the whole of the image forming system. The control circuit 26 has a central processing unit (CPU) (not shown) which controls the operation of the whole of the image forming system based on a program, ROM (not shown) in which the program and a table are stored, RAM (not shown) which temporarily provides a storage area to CPU, and an interface circuit (not shown) which relays a signal between CPU and the outside of the control circuit 26. A personal computer 40 of a user is externally connected to the image forming apparatus 2.

The control circuit 26 causes an operation panel 21 to display a message which prompts the user to input information on thicknesses of the sheets stored in the sheet trays 22 to 25, the sheet tray 31, and the inserter 6. The control circuit 26 causes the operation panel 21 to display the message, which prompts the user to input the information on the size of the sheet stored in the inserter 6. When the user operates the operation panel 21 to input the information, the inputted information is supplied from the operation panel 21 to the control circuit 26. Therefore, the control circuit 26 obtains sheet kind information indicating the kind of the sheet from the user. In advance of the start of the image formation, the control circuit 26 causes the operation panel 21 to display the message, which prompts the user to input the pieces of information on the size of the sheet constituting the booklet, the number of sheets, and the presence or absence of the bookbinding. When the user inputs the pieces of information by operating the operation panel 21, the inputted information is supplied from the operation panel 21 to the control circuit 26. Therefore, the control circuit 26 obtains the pieces of information on the size of the sheet constituting the booklet, the number of sheets, and the kind of the bookbinding from the user.

When an image forming instruction is provided to the control circuit 26 from the operation panel 21 or the externally connected personal computer 40 of the user, the control circuit 26 controls the image forming apparatus 2 to form the image on the sheet. The control circuit 26 controls the operations of the booklet producing unit 7, the trimming machine 8, the square folding device 9, and the stacker 10. For example, the control circuit 26 controls the operations of the clamping jaw 91, stop plate 92-roller 93, punch 94, and carry-out roller 95 which are incorporated into the square folding device 9.

Figure 3:
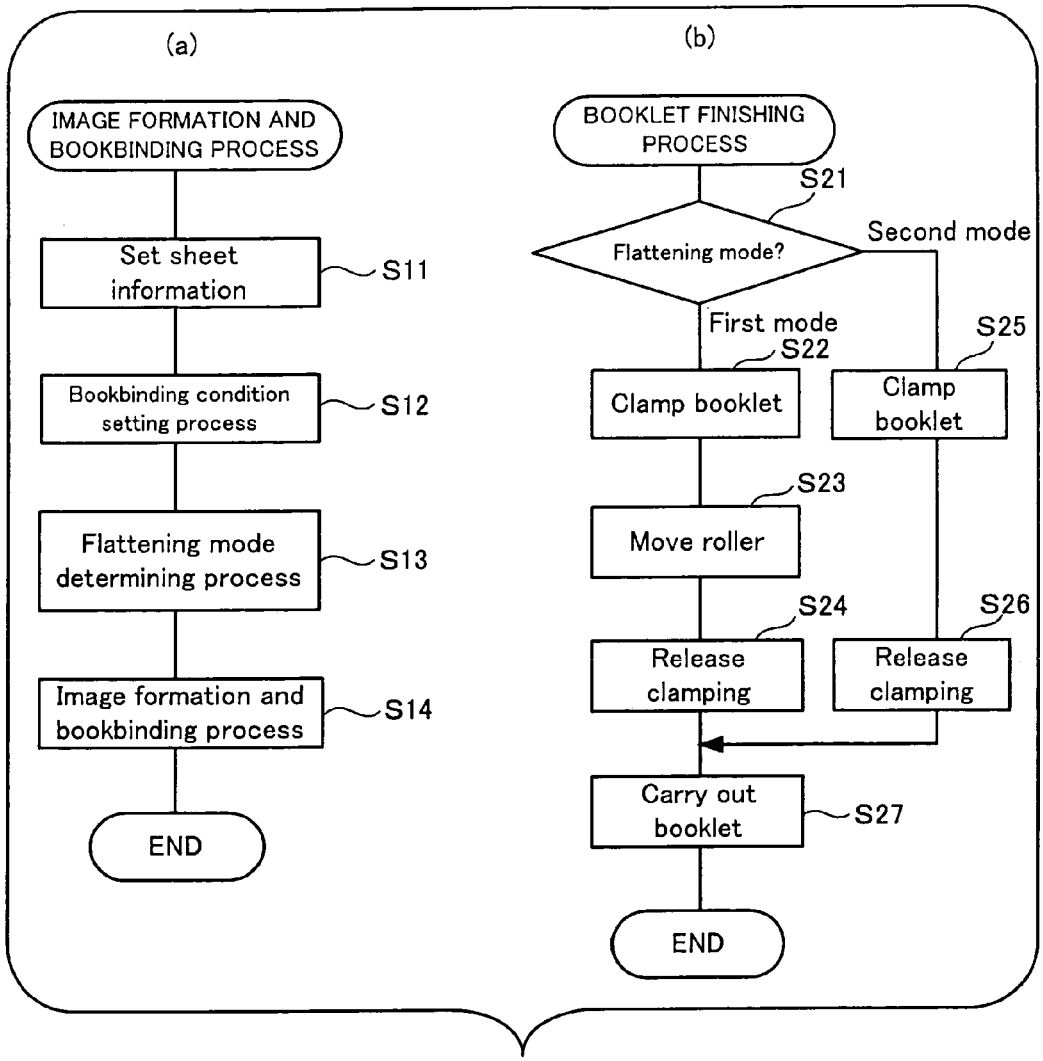
FIG. 3 is a flowchart showing an image formation and bookbinding process in the image forming system.

FIG. 3 is a flowchart showing an image formation and bookbinding process in the image forming system.

Part (a) of FIG. 3 shows the flowchart of the image formation and bookbinding process, and part (b) of FIG. 3 shows the flowchart of a booklet finishing process, which is a part of the image formation, and bookbinding process. The flowchart shown in FIG. 3 will be described with reference to FIG. 2.

In the image formation and bookbinding process, the control circuit 26 performs a sheet information obtaining process (Step S11). The control circuit 26 causes the operation panel 21 to display the message, which prompts the user to input the information on the thicknesses of the sheets stored in the sheet trays 22 to 25, the sheet tray 31, and the inserter 6. The control circuit 26 causes the operation panel 21 to display the message, which prompts the user to input the information on the size of the sheet stored in the inserter 6. When the user operates the operation panel 21 to input the information, the inputted information is supplied from the operation panel 21 to the control circuit 26.

Then, the control circuit 26 performs a bookbinding condition setting process (Step S12). The control circuit 26 causes the operation panel 21 to display the message. The message prompts the user to input the pieces of information on the number of sheets constituting the booklet, the size of sheet used, and the presence or absence of the bookbinding of the back of the booklet. When the user inputs the pieces of information on the number of sheets, the sheet size, and the presence or absence of the bookbinding of the booklet by operating the operation panel 21, the inputted information is supplied to the control circuit 26. Therefore, the control circuit 26 obtains the information from the user on the number of sheets and the sheet kind information indicating the kind of the bookbinding. The control circuit 26 also obtains the sheet kind information indicating the thickness of the sheet corresponding to the sheet size used. The tray in which the corresponding sheets are stored is selected according to the sheet size information.

Then, the control circuit 26 performs a process of determining a finishing mode in finishing the booklet with the square folding device 9 (Step S13). The finishing mode includes a first mode and a second mode. The finishing mode is determined and switched according to the information on the number of sheets, the sheet kind information, and the information on the presence or absence of the bookbinding, which are obtained in Steps S11 and S12.

Then, a method of determining the finishing mode will be described with reference to FIG. 4.

FIG. 4 is an example of a table showing a relationship between a finishing mode and a thickness, the number of sheets, a size, and presence or absence of booklet binding of sheets constituting the booklet. The contents of the table are stored in ROM of the control circuit 26. The two left-most rows in the table show determination conditions such as the thickness of content sheets constituting the booklet except for the cover and the number of content sheets. The two uppermost lines show determination conditions such as the saddle stitching, i.e., the presence or absence of the booklet binding and the thickness of the cover in the sheets. Each item of the table shows the finishing mode according to the determination conditions. In the table, "perform all processes" shall mean the first mode in which both the flattening of the booklet and the flattening of the back are performed, and "perform only first process" shall mean the second mode in which the booklet is flattened while the flattening of the back is not stopped. For example, in the table shown in FIG. 4, in the case where the conditions are as follows: the cover and content sheet have the thicknesses of 104 g/m$^2$, the cover is present, the number of content sheets is six, and the saddle stitching is performed, the finishing mode corresponds to "perform all processes" and the booklet is finished in the first mode. In this case, not only the booklet is flattened, but also the back is flattened. On the other hand, the case where the number of content sheets is three, the finishing mode corresponds to "perform only first process" and the booklet is finished in the second mode. In this case, the booklet is flattened while the flattening of the back is stopped.

Depending on the kind of the booklet, the projection portion is formed when the back is flattened. The projection portion is more easily formed as the booklet thickness is further decreased. The booklet thickness depends on the number of sheets constituting the booklet and the thickness of the sheet. The finishing mode is switched according to the conditions, such as the number of sheets and the thickness of the sheet, which determine the booklet thickness. Therefore, the booklet is flattened in the appropriate mode according to the kind of the booklet in the square folding device 9.

In the case where the saddle stitching is absent in the table of FIG. 4, all the finishing modes are set to the second mode. In the case where the booklet is not bound, usually it is assumed that the sheets constituting the booklet are taken out later. When the back of the booklet is flattened, the folding quality is degraded for the sheet taken out from the booklet. Therefore, in the case where the booklet is not bound, the finishing mode is set to the second mode, so that the booklet can be flattened while the sheet quality is maintained.

In the table of FIG. 4, "prohibit booklet production" shall mean that the booklet production is prohibited because the bookbinding is not appropriately performed by the booklet producing unit 7. As described later, the control circuit 26 performs the control such that the user does not select the conditions corresponding to "prohibit booklet production."

Returning to FIG. 3, the description will be continued.

In Step S13, the control circuit 26 refers to the table of FIG. 4 on the number of sheets constituting the booklet indicated by the information on the number of sheets, the booklet thickness indicated by the sheet kind information, and the presence or absence of the booklet binding indicated by the information on the presence or absence of the binding. Then, the control circuit 26 switches the finishing mode to the corresponding mode. In Step S12, the control circuit 26 previously reads the table of FIG. 4, and the control circuit 26 causes the operation panel 21 to display the message for prompting the user to input the information on another condition when the user inputs the information of the condition of "prohibit booklet production."

In the subsequent image formation and bookbinding process, the control circuit 26 controls the operations of the image forming apparatus 2, the booklet producing unit 7, the trimming machine 8, and the square folding device 9 to form the image in the sheet selected by the user, and the control circuit 26 performs the bookbinding (Step S14). In Step S14, the booklets are bound by the number of booklets specified in advance of the image forming instruction. In each time when the one booklet is bound, the control circuit 26 performs the booklet finishing process shown in part (b) of FIG. 3, which is a part of the image formation and bookbinding process.

Figure 5:
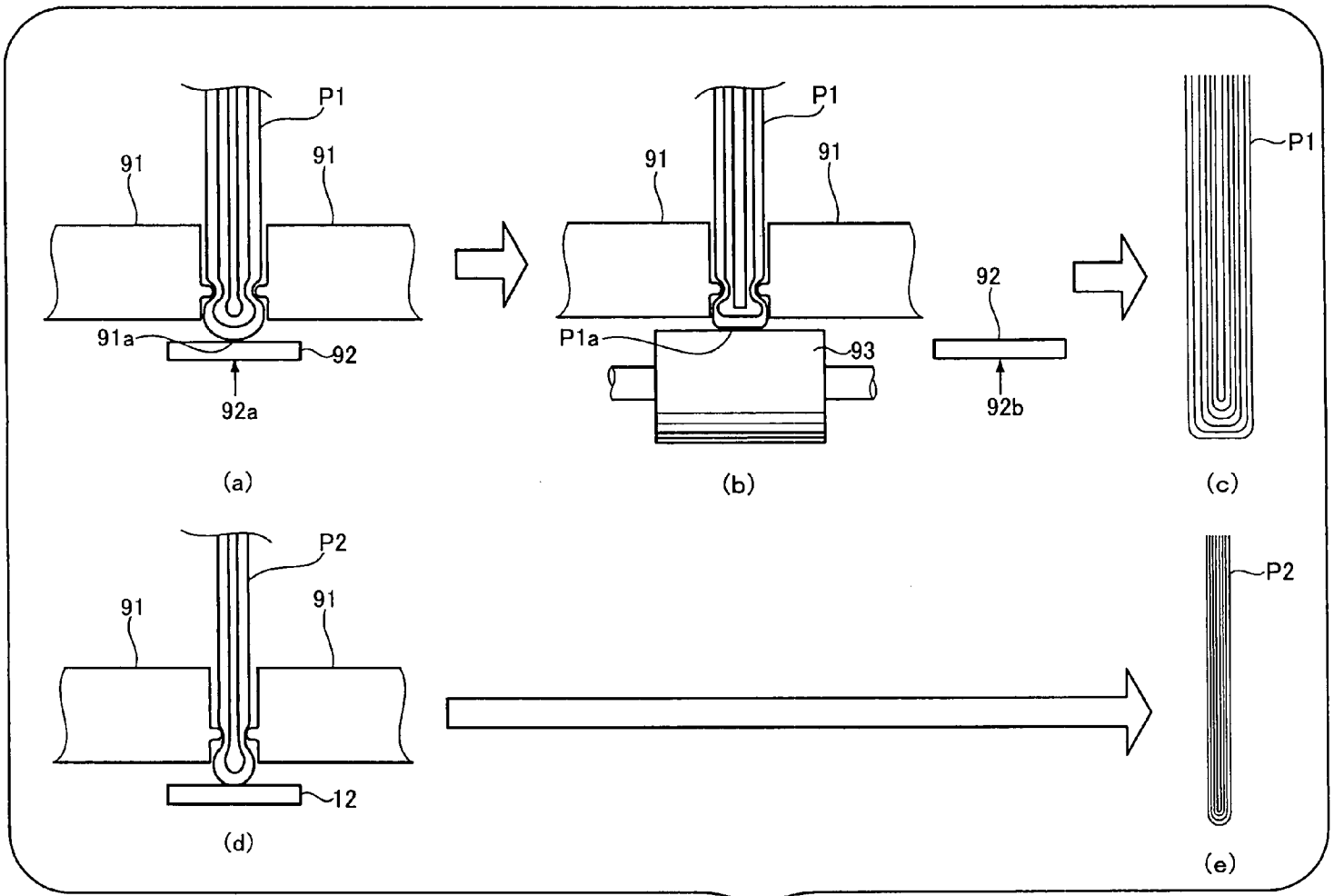
FIG. 5 shows an outline of booklet finishing in the first exemplary embodiment.
Figure 6:
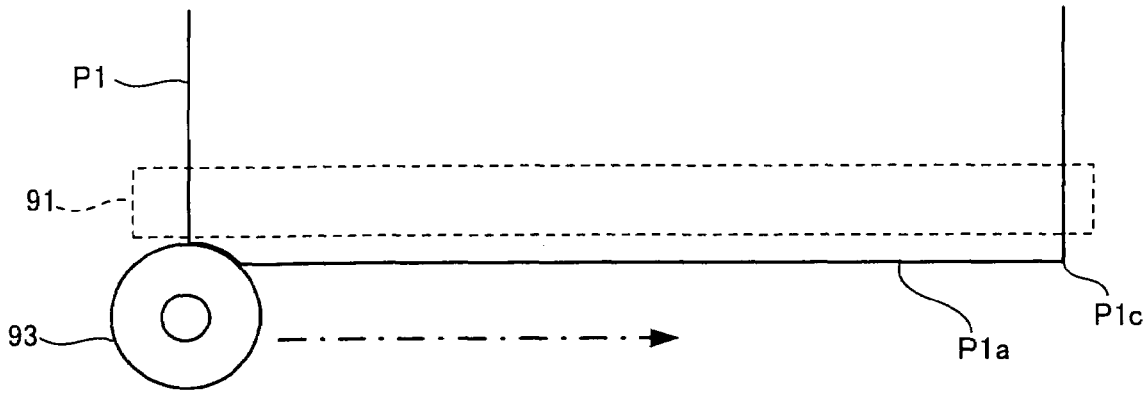
FIG. 6 shows an outline of the booklet finishing in the first exemplary embodiment.

FIGS. 5 and 6 show an outline of the booklet finishing in the first exemplary embodiment.

The booklet finishing process will be described with reference to FIGS. 5 and 6.

The booklet finishing process is started in synchronization with the conveyance of the booklet produced by the booklet producing unit 7 to the square folding device 9. The booklet conveyed to the square folding device 9 is caused to abut on the stop plate 92 arranged at a position 92*a* which closes the conveyance path of the booklet, and the booklet is positioned.

In the booklet finishing process, the control circuit 26 determines whether the finishing mode determined by the image formation and bookbinding process is the first mode or the second mode (Step S21). The finishing mode switched in Step S13 is performed by the determination in Step S21.

When the control circuit 26 determines that the finishing mode is the first mode, as shown in part (a) of FIG. 5, the clamping jaw 91 clamps a booklet P1 positioned by the stop plate 92 (Step S22). At this point, because the clamping jaw 91 clamps the portions close to a back of the booklet P1*a*, the swelled booklet is flattened.

Then, the control circuit 26 moves the roller 93 (Step S23). As shown in part (b) of FIG. 5 and FIG. 6, after the stop plate 92 is retracted from the conveyance path to a retracted position 92*b*, the roller 93 is moved from one end P1*b* to the other end P1*c* along the back of the booklet P1*a* while pressing the back of the booklet P1*a*. Therefore, the back of the booklet P1*a* is pressed and flattened by the roller 93 (square folding process). At this point, the sheets constituting the booklet are folded with an angle by the roller 93, which assists the flattening performed by the clamping jaw 91.

When the movement of the roller 93 is ended, the clamping jaw 91 releases the clamping of the booklet (Step S23), and the carry-out roller 95 carries out the booklet P1 to the stacker (Step S24). As shown in part (c) of FIG. 5, the carried-out booklet P1 is flattened, and the back of the booklet P1*a* is pressed and flattened by the roller 93.

On the other hand, in Step S21, when the control circuit 26 determined that the finishing mode is the second mode, as shown in part (d) of FIG. 5, the clamping jaw 91 clamps the portions close to a back P2*a* of a booklet P2 (Step S25). This enables the booklet P2 to be flattened. However, in the second mode, the roller 93 is stopped. The clamping jaw 91 releases the clamping of the booklet P2 after a predetermined time elapses (Step S26), and the carry-out roller 95 carries out the booklet P2 to the stacker (Step S24). As shown in part (e) of FIG. 5, the carried-out booklet P2 is flattened.

Thus, in the square folding device 9 of the first exemplary embodiment, the second mode is selected even for the relatively thin booklet P2, and the booklet P2 can be flattened when the clamping jaw 91 clamps the booklet P2. In the second mode, because the roller 93 is stopped, the decrease in quality of the booklet P2 caused by the generation of the projection portion is prevented. For the relatively thick booklet P1, by adopting the first mode, the back of the booklet can be flattened while the booklet P1 can be flattened.

Because the number of sheets processed per time is usually kept constant in the image forming apparatus 2, the number of booklets finished per time is increased as the number of sheets constituting the booklet is decreased. That is, in the relatively thin booklet P2, it is likely that the time necessary to produce the booklet is shorter than the time necessary for one-time square folding process. In this case, the second mode is selected to shorten the processing time of the square folding process by the time necessary for Step S23, so that the decrease in throughput of the whole caused by the processing time of the square folding process can be prevented.

The first mode and the second mode are switched according to the information on the number of sheets constituting the booklet and the booklet the sheet kind information indicating the kind of the sheet, so that the suitable finishing is selected for the booklet P1 and booklet P2 in which the booklet thicknesses are different from each other.

A second exemplary embodiment of the invention will be described below. In the second exemplary embodiment, the same components as the first exemplary embodiment are designated by the same reference characters, and only the difference with the first exemplary embodiment will be described.

Figure 7:
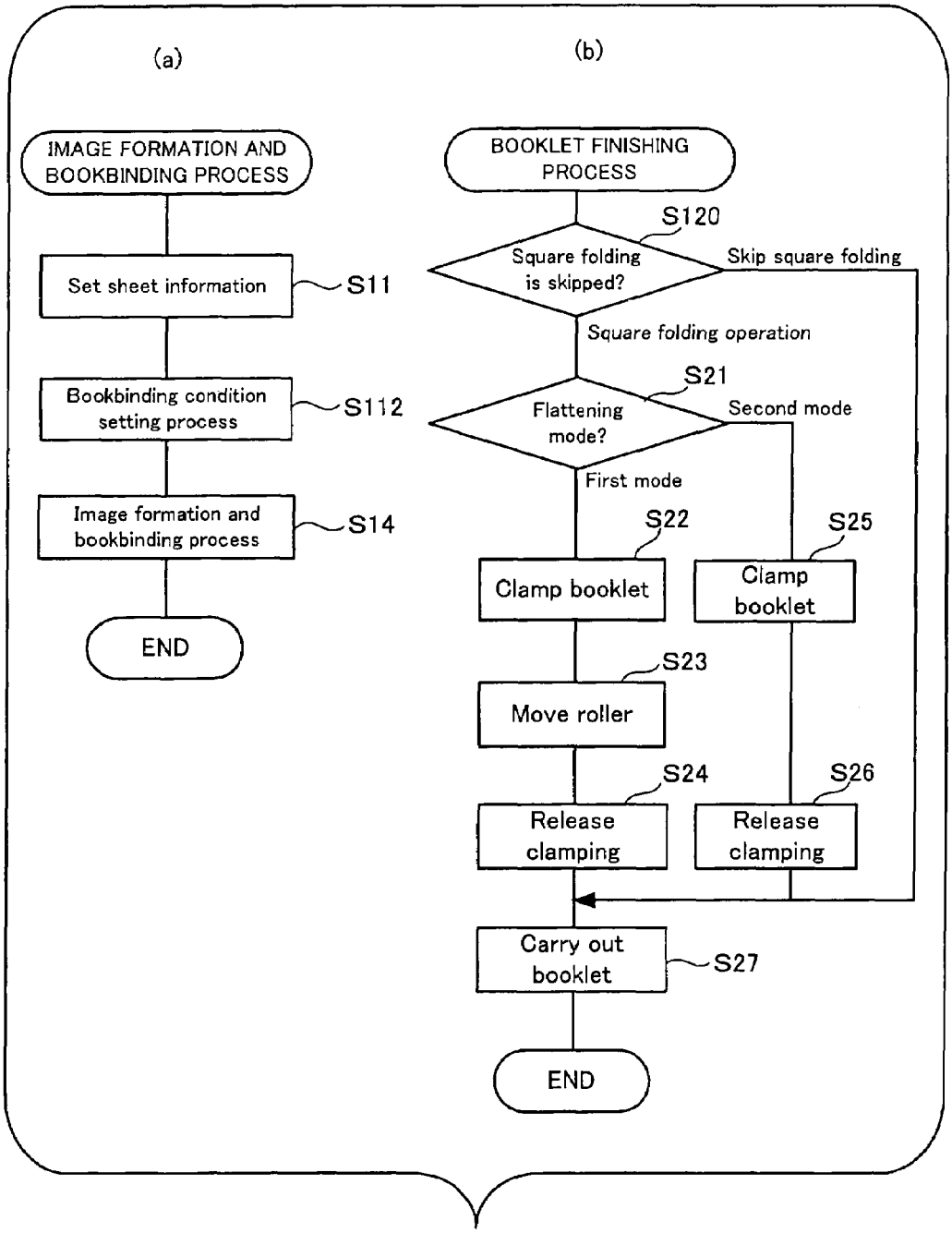
FIG. 7 is a flowchart showing the image formation and bookbinding process and a booklet finishing process in an image forming system according to a second exemplary embodiment.
Figure 8:
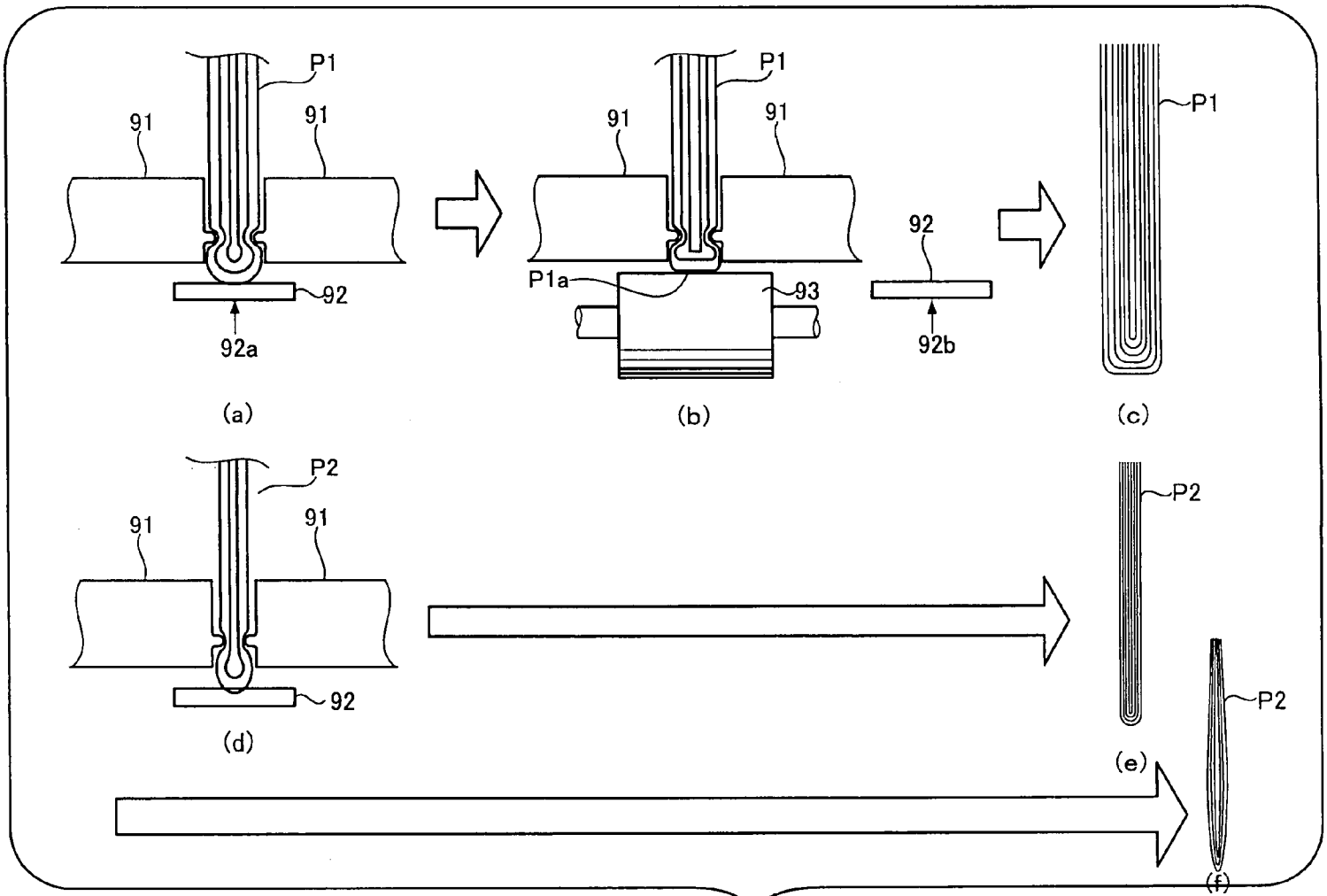
FIG. 8 shows an outline of the booklet finishing in the second exemplary embodiment.
Figure 9:
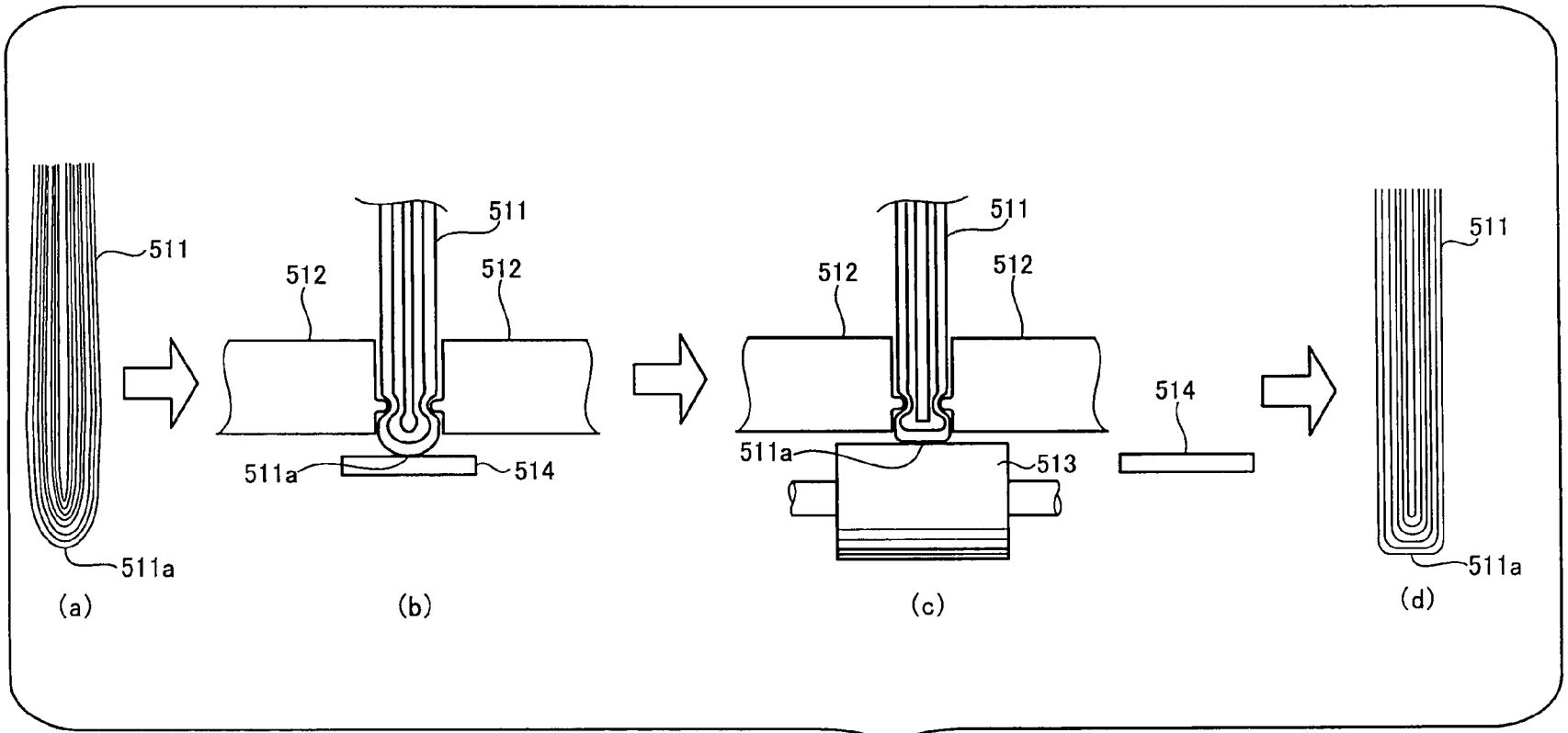
Fig. 9 Related Art
FIG. 9 shows an outline of a square folding process.
Figure 10:
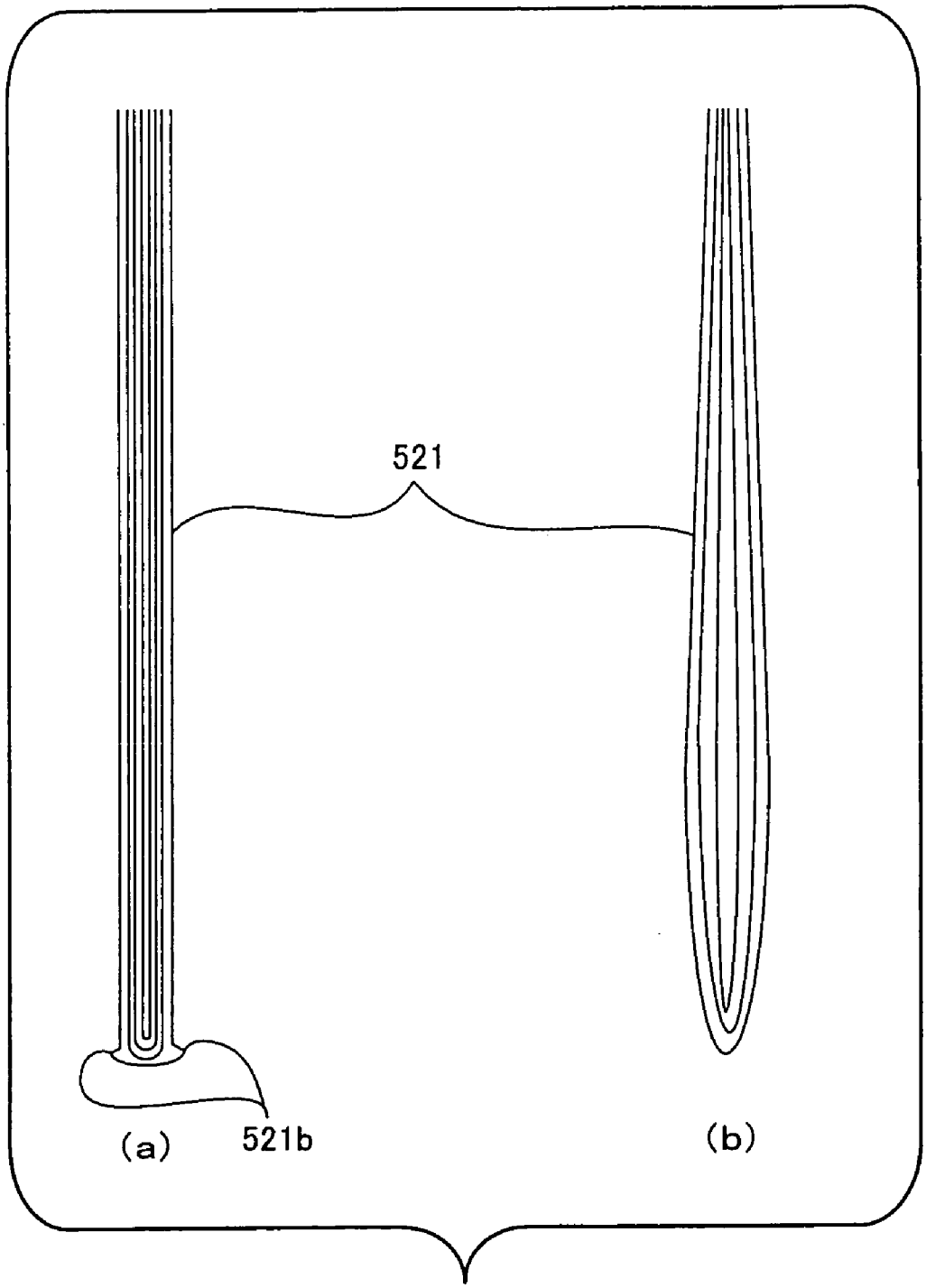
Fig. 10 Related Art
FIG. 10 shows a booklet different from the booklet of FIG. 9.

FIG. 7 is a flowchart showing the image formation and bookbinding process and the booklet finishing process in an image forming system of the second exemplary embodiment. FIG. 8 shows an outline of the booklet finishing in the second exemplary embodiment.

The second exemplary embodiment largely differs from the first exemplary embodiment in that the control circuit 26 switches between the first mode and the second mode based on a switching operation of the user. In the second exemplary embodiment, in a bookbinding condition setting process (Step S112) shown in part (a) of FIG. 7, the control circuit 26 causes the operation panel 21 (see FIG. 2) to display the following messages to the user. That is, the messages include the number of sheets constituting the booklet, the size of the sheet used, the presence or absence of the binding of the back of the booklet, the presence or absence of the finishing performed by the square folding device 9, and the a message which prompts the user to perform the mode switching operation for switching between the first mode and the second mode as the finishing mode in the case where the booklet finishing is performed. When the user operates the operation panel 21 to input the pieces of information on the number of sheets, the sheet size, and the presence or absence of the booklet binding, the pieces of information inputted to the operation panel 21 are supplied to the control circuit 26. When the user operates the operation panel 21 to select whether the finishing is performed or not, finishing selection information indicating the finishing selection is supplied to the control circuit 26. When the user operates the operation panel 21 to perform the mode switching operation for switching between the first mode and the second mode, mode switching operation information indicating the switched finishing mode is supplied to the control circuit 26. The control circuit 26 switches between the first mode and the second mode according to the obtained mode switching operation information. Thus, the user determines whether the projection portion is easily formed or not, and the control circuit 26 switches between the first mode and the second mode according to the mode switching operation of the user.

In the booklet finishing process shown in part (b) of FIG. 7, the booklet finishing is performed according to the finishing mode switched in Step S112. In the booklet finishing process, the control circuit 26 determines whether the finishing is performed by the square folding device 9 or not according to the finishing selection information (Step S120). When the finishing is not performed by the square folding device 9, as shown in part (f) of FIG. 8, the booklet is immediately carried out (Step S27). On the other hand, when the finishing is performed by the square folding device 9, the control circuit 26 determines whether the finishing mode switched in the image formation and bookbinding process is the first mode or the second mode (Step S21). In the first mode, the clamping jaw 91 clamps the booklet P1 to flatten the booklet P1 as shown in part (a) of FIG. 8, and the roller 93 flattens the back of the booklet P1 as shown in part (b) (square folding process). In the second mode, as shown in part (d), although the clamping jaw 91 clamps the booklet P1 to flatten the booklet P2 (Step S25), the roller 93 is stopped. Thus, the user determines whether the projection portion is easily formed or not, and the control circuit switches between the first mode and the second mode according to the mode switching operation information supplied by the mode switching operation of the user. Therefore, the finishing suitable for the kind of the booklet is performed according to the determination of the user.

In the above exemplary embodiments, the roller 93 is moved in parallel with the back of the booklet P1*a*. However, the invention is not limited to the exemplary embodiments. For example, in the forming unit of the invention, a wide roller may be moved in an oblique direction with respect to the back of the booklet to shorten the movement distance of the roller.

In the above exemplary embodiments, the roller 93 is moved along the back of the booklet P1*a*. However, the invention is not limited to the exemplary embodiments, but any forming unit is used as long as the forming unit breaks down the back along the back of the booklet. For example, the roller may be fixed while the booklet may be moved.

In the above exemplary embodiments, the roller 93 is formed in the cylindrical shape. However, the invention is not limited to the exemplary embodiments. For example, the forming unit may be formed by a roller having a truncated cone shape or the shape in which the truncated cones are combined.

In the above exemplary embodiments, the roller is cited as a forming unit. However, the invention is not limited to the exemplary embodiments, but any forming unit is used as long as the forming unit presses and flattens the back of the booklet. For example, a member having a surface facing the back of the booklet may press the back of the booklet with the surface.

In the above exemplary embodiments, the clamping jaw 91 clamps the booklet from the both cover sides. However, the invention is not limited to the exemplary embodiments. For example, the clamping unit may be two rollers clamping the booklet. In the above exemplary embodiments, the pair of clamping jaws 91 is used. However, the invention is not limited to the exemplary embodiments. For example, the booklet may be clamped by plural pairs of members.

In the above exemplary embodiments, the control circuit 26 is incorporated into the image forming apparatus 2. However, the invention is not limited to the exemplary embodiments. For example, the control circuit may be mounted on the square folding device.

In the first exemplary embodiment, the control circuit switches between the first mode and the second mode based on the information indicating the number of sheets constituting the booklet and the information indicating the sheet thickness. However, the invention is not limited to the first exemplary embodiment. For example, the control circuit may switch between the first mode and the second mode based on either the information indicating the number of sheets constituting the booklet or the information indicating the sheet thickness.

Figure 11:
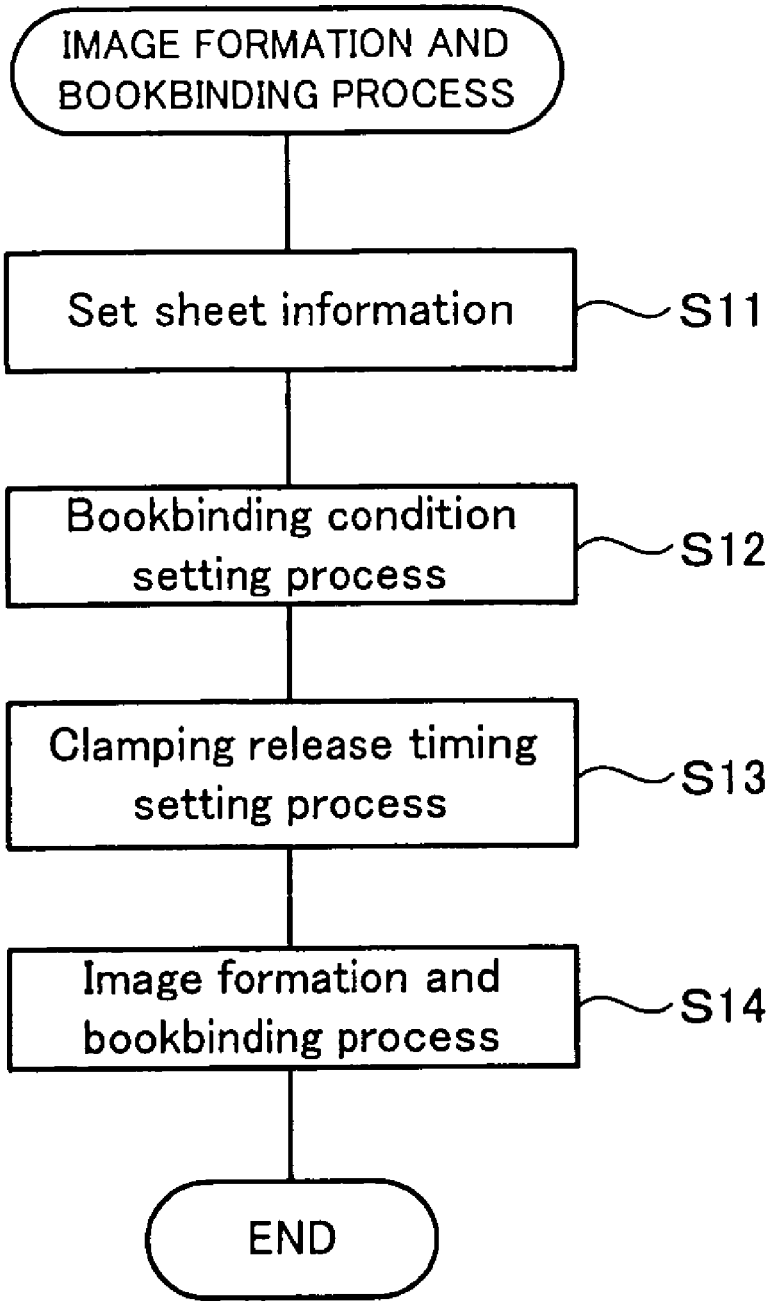
FIG. 11 is a flowchart showing another example of the image formation and bookbinding process in the image forming system.

FIG. 11 is a flowchart showing another example of the image formation and bookbinding process in the image forming system.

The control circuit 26 shown in FIG. 2 controls the operation of each unit based on a program, which realizes the image formation and bookbinding process shown in FIG. 11. The flowchart of FIG. 11 will be described with reference to FIG. 2.

In the image formation and bookbinding process, the control circuit 26 performs a sheet information obtaining process (Step S11). The control circuit 26 causes the operation panel 21 to display the message which prompts the user to input the information on the thicknesses of the sheets stored in the sheet trays 22 to 25, the sheet tray 31, and the inserter 6. The control circuit 26 causes the operation panel 21 to display the message which prompts the user to input the information on the size of the sheet stored in the inserter 6. When the user operates the operation panel 21 to input the information, the inputted information is supplied from the operation panel 21 to the control circuit 26.

Then, the control circuit 26 performs the bookbinding condition setting process (Step S12). The control circuit 26 causes the operation panel 21 to display the message. The message prompts the user to input the pieces of information on the number of sheets constituting the booklet and the size of sheet used. When the user operates the operation panel 21 to input the pieces of information on the number of sheets and the sheet size, an instruction of a job for producing the booklet is issued while the inputted information is supplied to the control circuit 26. At this point, the control circuit 26 obtains the information on the number of sheets from the user. The control circuit 26 also obtains the sheet thickness information indicating the thickness of the sheet corresponding to the sheet size used from the information on the size of the sheet used. The tray in which the corresponding sheets are stored is selected according to the sheet size information.

Then, the control circuit 26 sets clamping release timing (Step S13). The clamping release timing is timing at which the clamping jaw 91 (see FIG. 2) of the square folding device 9 releases the clamping of the booklet. In the second exemplary embodiment, as described later, the control circuit 26 causes the clamping jaw 91 to release the clamping of the booklet at faster timing in either production end timing at which the production end signal is received or the clamping release timing. The clamping release timing is determined based on the information on the number of sheets and the sheet thickness information. Specifically, the clamping release timing is determined according to prediction of the time necessary to produce one booklet using the booklet producing unit 7. The sheets which are folded in the booklet by the booklet producing unit 7 are one of which the image forming apparatus 2 forms the images on the both surfaces. Therefore, actually the time necessary to produce one booklet using the booklet producing unit 7 is substantially equal to the time during which the images are formed in all the sheets constituting one booklet using the image forming apparatus 2. The time during which the images are formed in all the sheets constituting one booklet is a product of the time necessary to form the image per one sheet and the number of sheets constituting the booklet. In the case of the sheet having the usual thickness, the time to form the image per one sheet is about one second, and the time necessary to produce one booklet constituting 30 sheets is about 30 seconds. In the image forming apparatus 2 in which the image is formed by the electrophotographic process, for the relatively thick sheet, it takes more time to fix toner to the sheet. In the case of the thick sheet, the time necessary to form the image in one sheet becomes about two seconds, and the time necessary to produce one booklet constituting 30 sheets is about 60 seconds.

In the case where the sheet thickness information indicates the usual sheet, the control circuit 26 sets a value, in which a predetermined time is added to the product of one second and the number of sheets indicated by the information on the number of sheets, at clamping release timing in STEP S13. In the case where the sheet thickness information indicates the thick sheet, the control circuit 26 sets a value, in which a predetermined time is added to the product of two seconds and the number of sheets indicated by the information on the number of sheets, at clamping release timing.

In the subsequent image formation and bookbinding process, the control circuit 26 controls the operations of the image forming apparatus 2, the booklet producing unit 7, the trimming machine 8, and the square folding device 9 to form the image in the sheet selected by the user, and the control circuit 26 performs the bookbinding (Step S14). In Step S14, the booklets are bound by the number of booklets specified in advance of the job instruction. In each time when the one booklet is bound, the control circuit 26 performs the square folding process which is a part of the image formation and bookbinding process.

Figure 12A:
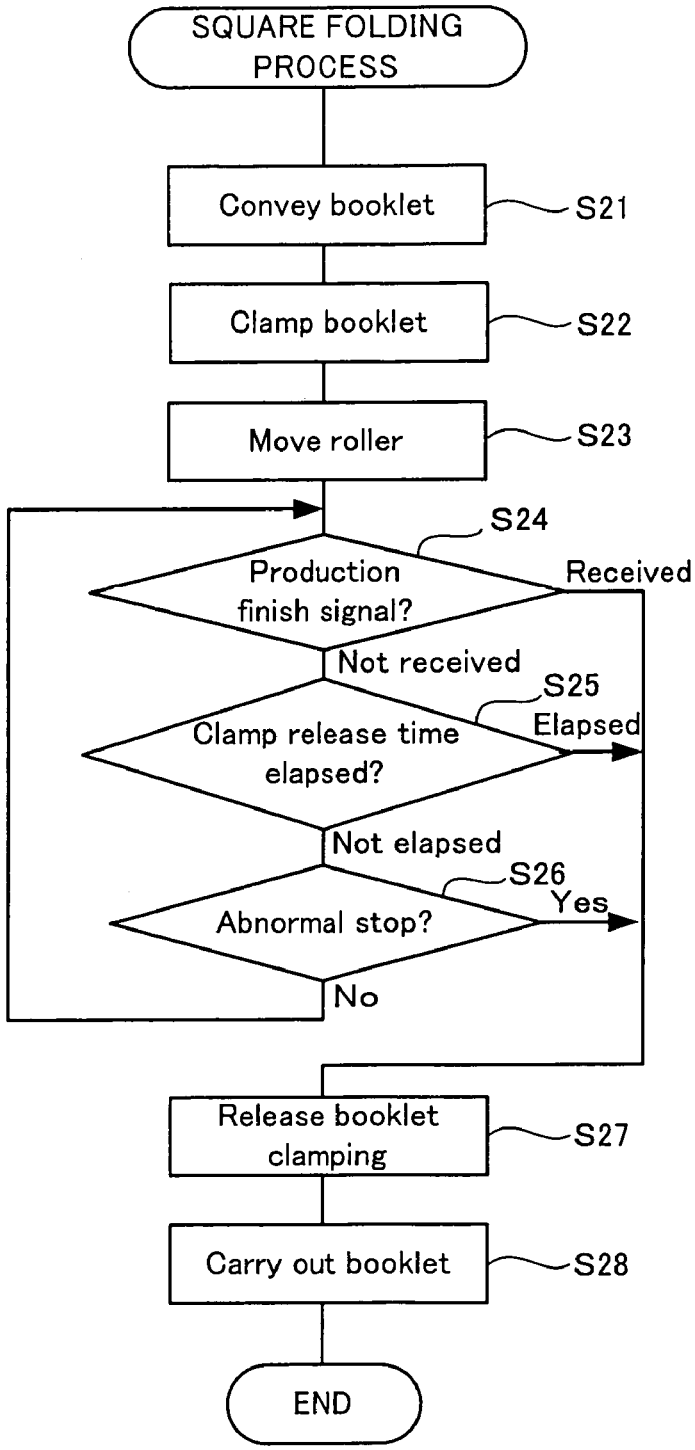
FIGS. 12A and 12B are flowcharts each showing the square folding process.

FIG. 12A is a flowchart showing the square folding process.

The control circuit 26 (see FIG. 2) controls the operation of each unit based on the program, which realizes the square folding process shown in FIG. 12A. In Step S21, the booklet is conveyed. The carry-out roller 95 conveys the booklet P1 from the trimming machine 8. The conveyed booklet P1 is caused to abut on the stop plate 92 arranged at the position, which closes the conveyance path of the booklet, and the booklet P1 is positioned.

Then, the clamping jaw 91 clamps the booklet P1 positioned by the stop plate 92 (Step S22). At this point, because the clamping jaw 91 clamps the portions close to a back of the booklet P1*a*, the swelled booklet is flattened. In Step S22, the control circuit 26 starts to count the time, which is set as the clamping release timing in Step S13.

Then, the roller 93 is moved (Step S23). After the stop plate 92 is retracted from the conveyance path to the retracted position, the roller 93 is moved from one end to the other end along the back of the booklet while pressing the back of the booklet. Therefore, the back of the booklet is pressed and flattened by the roller 93. At this point, the sheets constituting the booklet are folded with an angle by the roller 93, which facilitates the flattening performed by the clamping jaw 91. Thus, while the booklet is clamped and flattened by the clamping jaw 91, the back becomes flattened by the roller 93.

After the movement of the roller is ended, the control circuit 26 determines whether the production end signal is received or not (Step S24). When the control circuit 26 determines that the production end signal is received, the control circuit 26 assumes that the production of the booklet subsequent to the clamped booklet P1 is ended, and the control circuit 26 performs booklet clamping release process (Step S27) by the booklet producing unit 4.

In Step S24, when the control circuit 26 determines that the production end signal is not received, the control circuit 26 determines whether the clamping release timing has passed or not (Step S25). Specifically, the control circuit 26 determines whether the clamping release timing set in Step S13 passed or not based on the counting result of the time started in Step S22. When the control circuit 26 determines that the clamping release timing has passed, the control circuit 26 performs booklet clamping release process (Step S27).

In Step S25, when the control circuit 26 determines that the clamping release timing has not passed, the control circuit 26 determines whether abnormal stop exists or not (Step S26). On the basis of signals outputted from various sensors attached to the booklet producing unit 7 and trimming machine 8, the control circuit 26 determines whether or not the booklet production is interrupted by the abnormal stop caused by paper jam or the like. When the control circuit 26 determines that the booklet production is interrupted (Yes in Step S26), the control circuit 26 performs booklet clamping release process (Step S27). Therefore, although the booklet remains in the booklet producing unit 7 while bound partway, the already produced booklet is carried out to the stacker 10 without residence in the square folding device 9.

When the control circuit 26 determines that the booklet production is not interrupted (No in Step S26), the control circuit 26 repeats the processes from Step S24. Therefore, the clamping jaw 91 clamps the booklet even after the roller 93 completes the flattening of the back of the booklet portion.

In Step S27, the control circuit 26 causes the clamping jaw 91 to release the clamping of the booklet.

In Step S28, the control circuit 26 causes a conveyance roller to convey the booklet, and the control circuit 26 causes the punch 94 to make a hole. Then, the control circuit 26 causes the carry-out roller 95 to carry out the booklet. The carried-out booklet is loaded on the stacker 10. Then, the control circuit 26 repeats the square folding process from the beginning. Therefore, the square folding device 9 proceeds to the process of finishing the booklet.

Through Steps S24, S25, and S27, the control circuit 26 enables the next booklet to be processed by causing the clamping jaw 91 to release the clamping of the booklet at faster timing in either the timing at which the production end signal is received or the clamping release timing. The clamping release timing is determined based on the thickness and the number of sheets constituting the booklet. The timing at which the production end signal is received is the production end timing at which the production of the next booklet by the trimming machine 8 is actually ended. However, in the clamping release timing, the additional time is slightly added to the time necessary to produce the booklet. Therefore, usually the clamping of the booklet is released by receiving the production end signal (Step S24). Accordingly, the timing at which the clamping of the booklet is released is properly adjusted to the timing at which the production is actually ended in the trimming machine 8, and the booklet is flattened by fully utilizing the time to which the production is ended. On the other hand, sometimes the next booklet does not exist in the trimming machine 8 while the final booklet in the job is clamped by the clamping jaw 91, or sometimes the booklet production time is abnormally lengthened due to delay of the sheet tray switching. In such cases, the booklet can be carried out to the stacker 10 without delay by releasing the clamping of the booklet at the clamping release timing (Step S25).

Because the booklet producing unit produces the booklet by folding the plural sheets, the time necessary to produce one booklet is increased as the number of sheets constituting the booklet is increased. In the second exemplary embodiment, the production end timing is delayed as the number of sheets constituting the booklet is increased, and the time during which the booklet is clamped is lengthened according to the delay of the production end timing, so that the booklet is securely flattened. Accordingly, the booklet can be flattened by fully utilizing the time from when the booklet P2 is completed until the square folding device 9 proceeds to the finishing process of the next booklet. Sometimes the next booklet does not exist in the trimming machine 8 while the final booklet in the job is clamped by the clamping jaw 91, or sometimes the specified sheets run out in the trays 23 to 25 to delay the production of the next booklet in the booklet producing unit 4. In such cases, the production end signal is not outputted from a carry-out sensor. Even in this case, when the set clamping release timing passes, the clamping of the booklet P1 is released, so that the booklet is carried out to the stacker without delay.

According to the second exemplary embodiment, it is not necessary to increase clamping force of the clamping jaw. Therefore, there is not generated the problem that production cost is increased due to the increase in strength or rated power of the apparatus.

In the second exemplary embodiment, the carry-out signal outputted from the carry-out sensor is set at the production end signal. The carry-out sensor detects that the booklet is carried out from the carry-out roller to the square folding device 9. However, the sensor which is attached to a place different from the second exemplary embodiment may be used as the sensor which outputs the production end signal indicating that the production of one booklet is ended in the booklet producing unit 4.

In the second exemplary embodiment and the modification thereof, the signal which is outputted from the sensor attached to the trimming machine 8 is set at the production end signal. However, the sensor which outputs the production end signal may be attached to other portions except for the trimming machine 8.

In the second exemplary embodiment and the modification thereof, the end of the production of one booklet in the trimming machine 8 is detected by utilizing the sensor. However, in the case where it is not necessary to strictly determine whether the production of one booklet is ended or not, the sensor may not be used.

The clamping release timing is determined as the time necessary to produce one booklet in the booklet producing unit 7, and the clamping release timing is determined based on the information on the number of sheets and the sheet thickness information in the release time setting process. In the second exemplary embodiment, the clamping of the booklet by the clamping jaw 91 is released at the clamping release timing which is determined by predicting the time necessary to produce the booklet in the booklet producing unit 4 based on the information on the number of sheets and the sheet thickness information.

In the second exemplary embodiment and the modification thereof, it is determined whether the clamping release timing determined based on the information on the number of sheets and the sheet thickness information has passed or not, and the clamping jaw 91 releases the clamping of the booklet when the clamping release timing has passed. In the case where it is not necessary to carry out the final booklet in the print job at proper timing, the determination based on the clamping release timing may not be made. Then, a third exemplary embodiment of the invention will be described. In the third exemplary embodiment, the determination is not made according to the clamping release timing. In the third exemplary embodiment, the same component as the first and second exemplary embodiments is designated by the same reference characters, and only the difference with the first and second exemplary embodiments will be described.

Figure 12B:
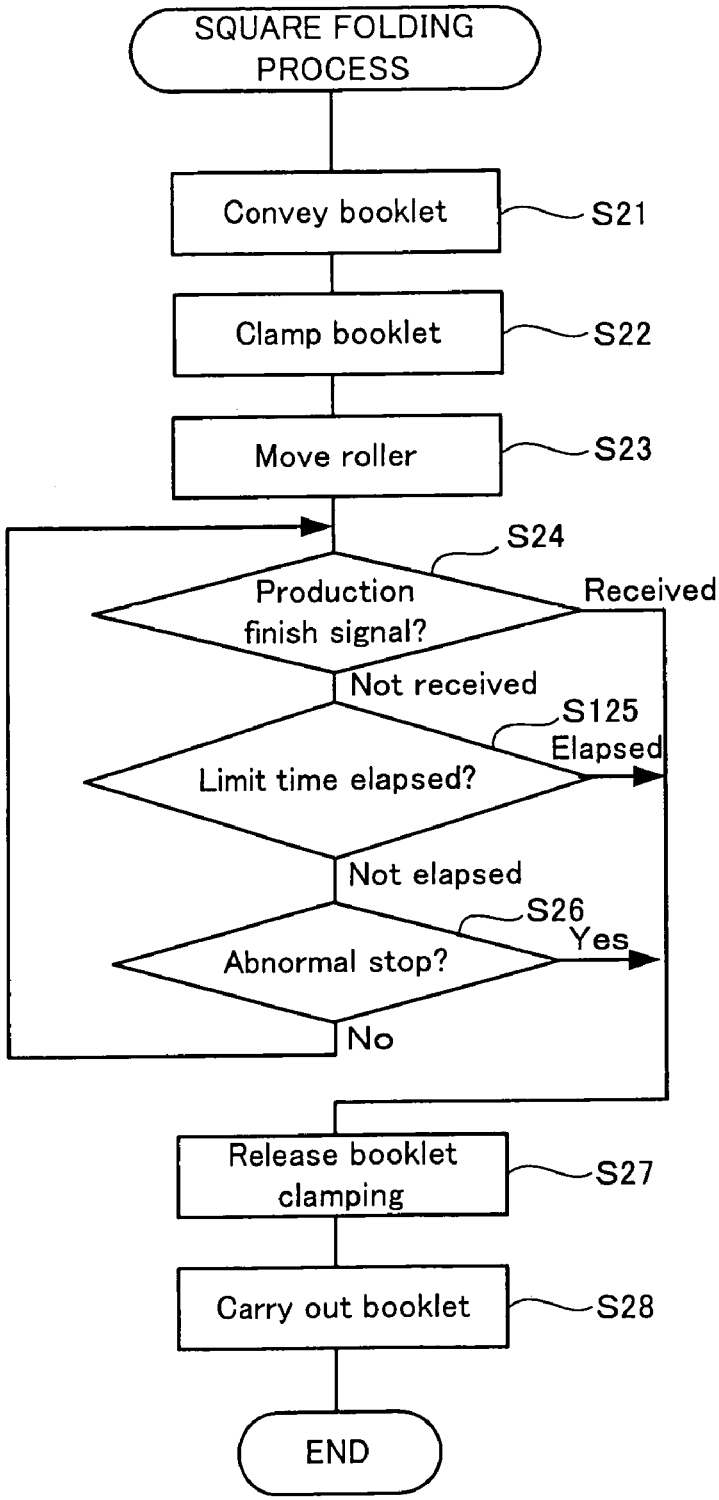

FIG. 12B is a flowchart showing the square folding process in a third exemplary embodiment.

The determination whether the release time has passed or not shown in Step S25 of the square folding process of FIG. 12A is not made in the square folding process of the third exemplary embodiment. In the third exemplary embodiment, the control circuit 26 determines whether the production end signal is received or not (Step S24). When the control circuit 26 determines that the production end signal is received, assuming that the booklet subsequent to the clamped booklet P1 is carried out from the carry-out roller to the square folding device 9, the control circuit 26 performs the booklet clamping release process (Step S27). When the control circuit 26 determines that the production end signal is not received, the control circuit 26 determines whether a limit time has elapsed or not (Step S125). As used herein, the limit time shall mean the maximum time necessary to produce the booklet, and the limit time is a constant value irrespective of the number of sheets of the booklet. Accordingly, even if the next booklet does not exist in the trimming machine 8 while the last booklet of the print job is clamped by the clamping jaw 91, the booklet is carried out when the limit time elapses.

In the third exemplary embodiment, because the signal outputted from the carry-out sensor is used as the booklet production end signal, the timing at which the clamping of the booklet is released can properly be adjusted to the timing at which the production is actually ended in the post-treatment apparatus 5, so that the booklet can securely be flattened by fully utilizing the time to which the booklet producing unit 7 proceeds to the finishing process of the next booklet.

In the third exemplary embodiment, the post-treatment apparatus 5 includes the inserter 6, the booklet producing unit 7, and the trimming machine 8. However, the invention is not limited to the third exemplary embodiment. For example, the post-treatment apparatus 5 may not include the trimming machine. In this case, when the folding of the sheets is ended in the booklet producing unit, the production of the booklet is ended in the post-treatment apparatus 5. The sensor provided in the booklet producing unit detects the end of the booklet production.

In the third exemplary embodiments, the roller is moved in parallel with the back of the booklet P1*a*. However, the invention is not limited to the third exemplary embodiment. In the forming unit of the invention, for example, a wide roller may be moved in an oblique direction with respect to the back of the booklet to shorten the movement distance of the roller.

In the third exemplary embodiments, the roller 93 is moved along the back of the booklet. However, the invention is not limited to the third exemplary embodiment, but any forming unit is used as long as the forming unit breaks down the back along the back of the booklet. For example, the roller may be fixed while the booklet may be moved.

The shape of the roller 93 is not limited to the cylindrical shape. For example, the forming unit may be formed by a roller having a truncated cone shape or the shape in which the truncated cones are combined.

In the third exemplary embodiment, the roller 93 is used as an example of the forming unit. However, the invention is not limited to the third exemplary embodiment, but any forming unit is used as long as the forming unit presses and flattens the back of the booklet. For example, a member having a surface facing the back of the booklet may press the back of the booklet with the surface.

In the third exemplary embodiment, the clamping jaw 91 clamps the booklet from the both cover sides. However, the invention is not limited to the third exemplary embodiment. For example, the clamping unit may be two rollers clamping the booklet. In the third exemplary embodiment, the pair of clamping jaws 91 is used. However, the invention is not limited to the third exemplary embodiment. For example, the booklet may be clamped by plural pairs of members.

In the third exemplary embodiment, the control circuit 26 is incorporated into the image forming apparatus 2. However, the invention is not limited to the third exemplary embodiment. For example, the control circuit may be mounted on the square folding device.

In the third exemplary embodiment, the clamping release timing is determined based on the information on the number of sheets and the sheet thickness information. However, the invention is not limited to the third exemplary embodiment. For example, the clamping release timing may be determined based on either the information on the number of sheets or the sheet thickness information.

The above-described square folding process has a tendency to generate a bias in the booklet thickness. When the plural booklets are put one on top of the other, the alignment state is disturbed.

Figure 22:
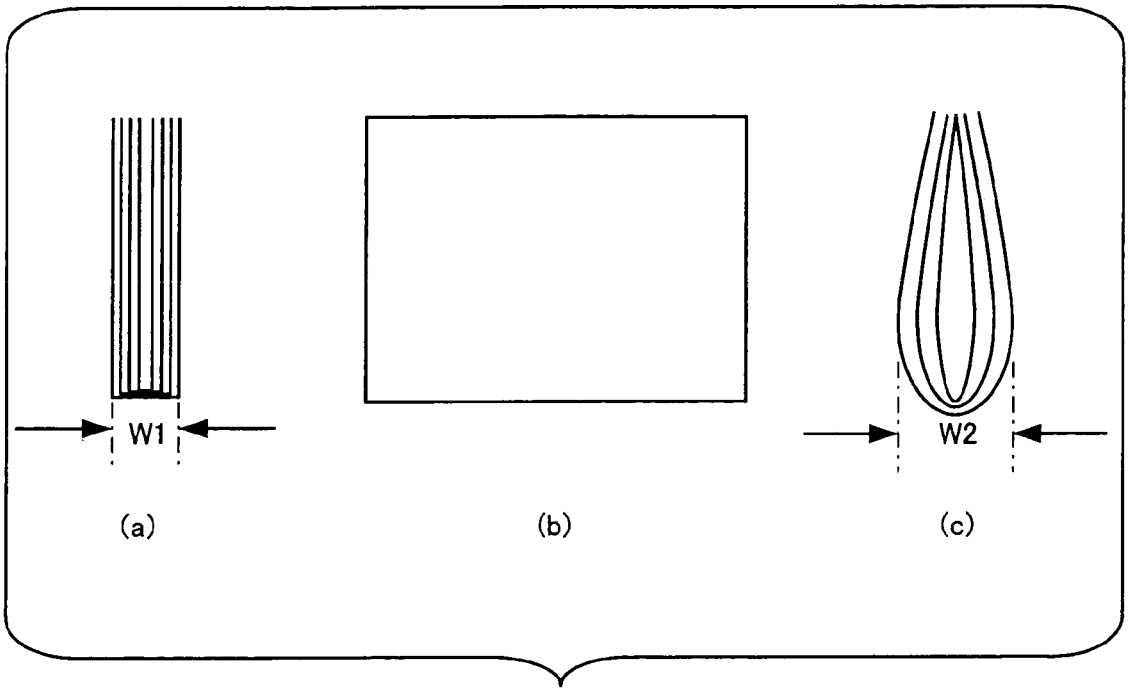
FIG. 22 shows a booklet after the back portion is flattened.

FIG. 22 shows the booklet after the back portion is flattened. Part (b) of FIG. 22 shows the booklet when viewed from the cover side, and parts (a) and (c) of FIG. 22 show the booklet from the left side and the right side respectively. As shown in FIG. 22, the back of the booklet is not evenly flattened, and a degree of flattening is gradually decreased from one end side to the other end side of the booklet. As a result, a thickness W1 on one end side of the back of the booklet differs from a thickness W2 on the other end side. Parts (a) and (c) of FIG. 22 exaggeratingly show the difference in the degree of flattening of the booklet for the sake of easy understanding.

Figure 23:
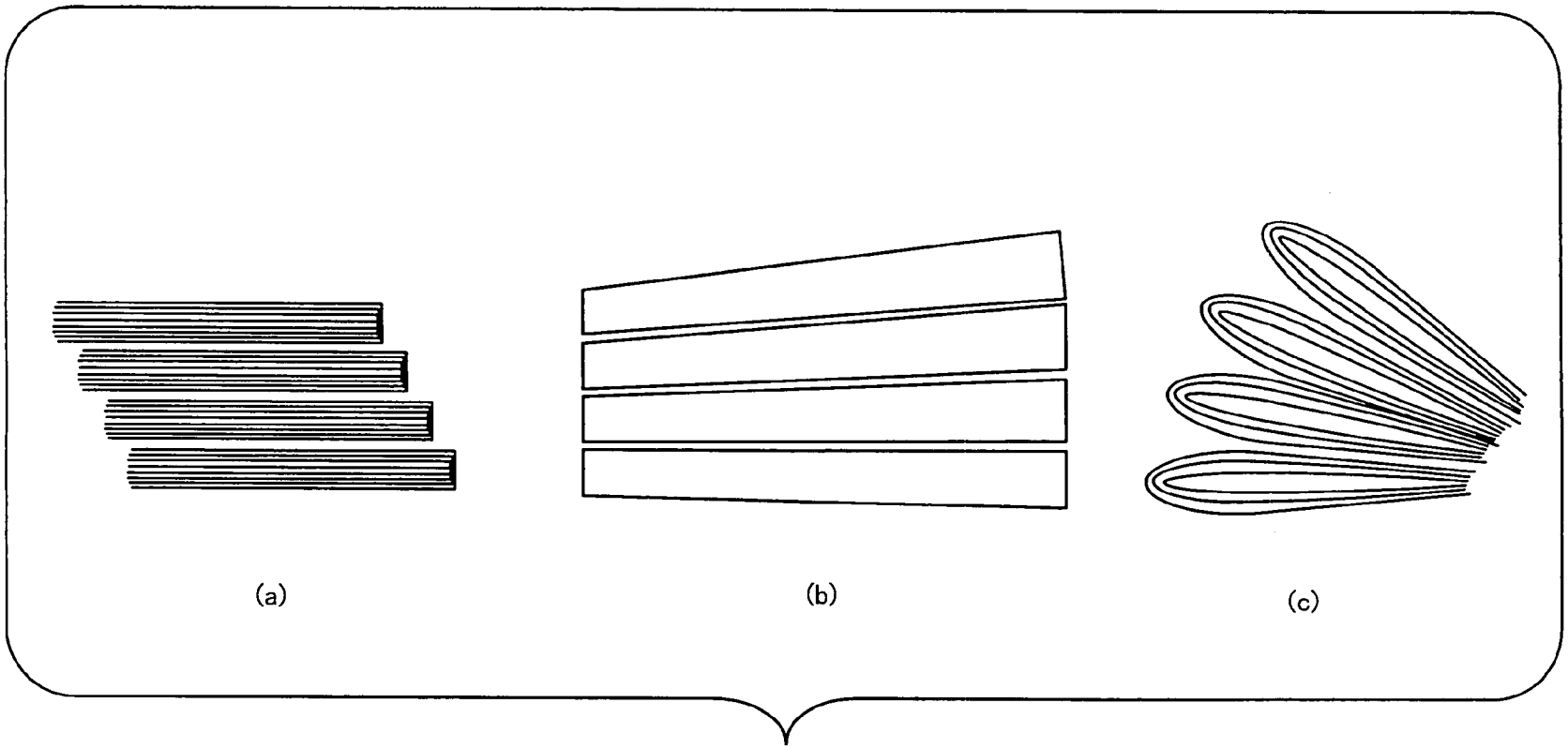
FIG. 23 shows a state in which the plural booklets whose back portions are flattened are loaded while overlapping one another in the conventional technique.
Figure 24:
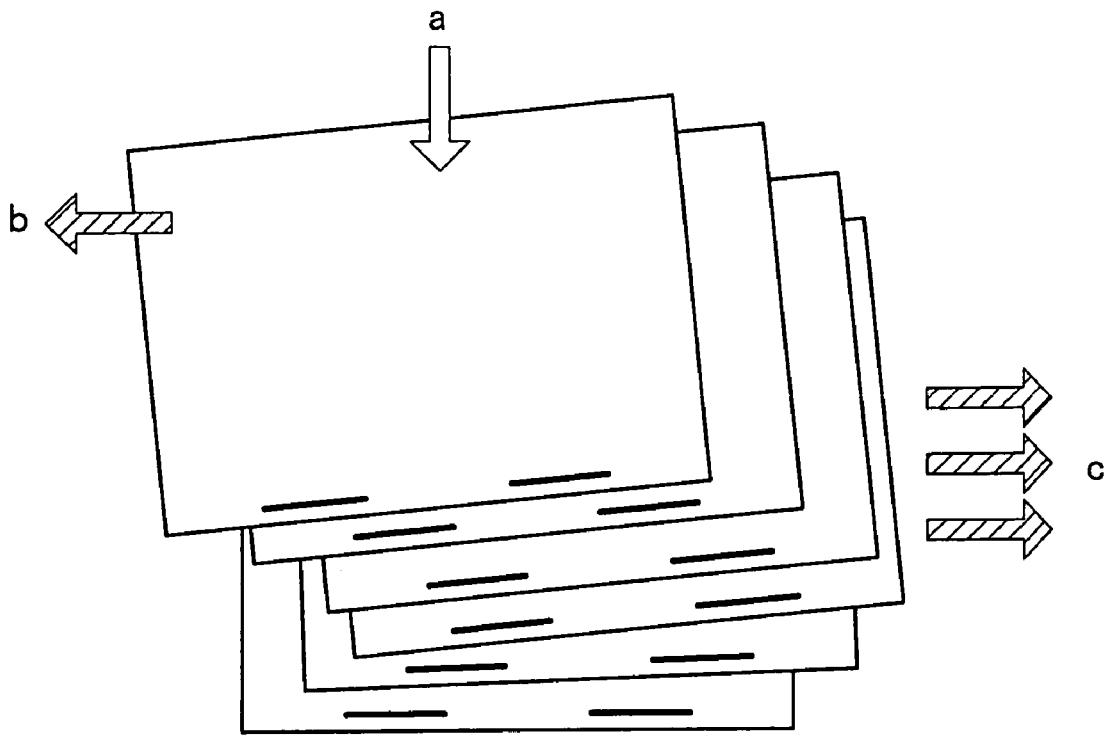
FIG. 24 shows a state in which the plural booklets whose back portions are flattened are loaded while overlapping one another in the conventional technique.

FIGS. 23 and 24 show a state in which the plural booklets whose back portions are flattened are loaded while overlapping one another in the conventional technique.

Part (b) of FIG. 23 shows the loaded booklets when viewed from the back side, and parts (a) and (c) of FIG. 23 show the loaded booklets from the left side and the right side respectively. FIG. 24 is a plan view showing the loaded booklets. As shown in FIG. 23, the bias of each booklet thickness is accumulated by loading the booklets. As a result, as shown in FIG. 24, when the booklets are sequentially loaded in a direction a, the newly loaded booklet drops out in a direction b, and the booklet loaded halfway tends to easily fly out in a direction c. Thus, when the booklets are put one on top of the other, the alignment state is disturbed due to the uneven thickness of the back of the booklet. Accordingly, the number of loaded booklets is remarkably restricted.

An embodiment of the invention may provide the booklet finishing apparatus, the post-treatment apparatus, and the image forming system for finishing the booklet in which the many booklets may be loaded by keeping alignment state well when the booklets are put one on top of the other. Therefore, the roller 93 is adapted to be controlled as follows.

Figure 13:
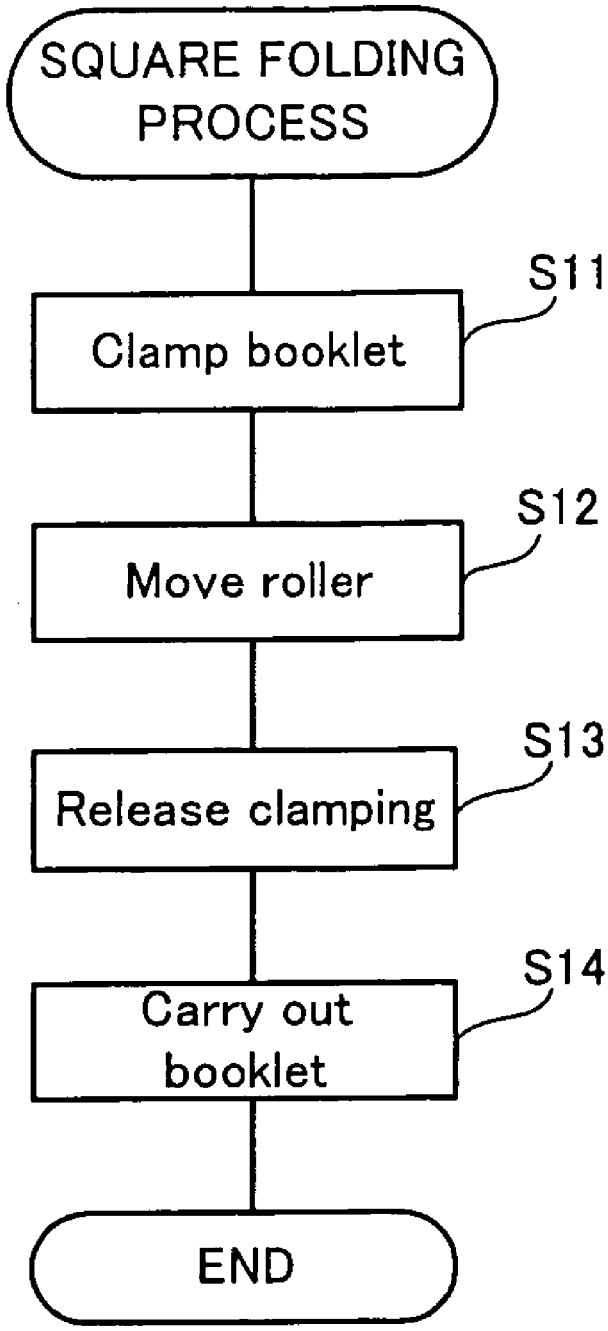
FIG. 13 is a flowchart showing a procedure of the square folding process.

FIG. 13 is a flowchart showing a procedure of the square folding process.

The square folding process is performed by operating the clamping jaw 91, the stop plate 92, the roller 93, the punch 94, and the carry-out roller 95 based on the control of the control circuit 26. The control circuit 26 performs the control of the square folding process which is of a part of the image formation and bookbinding process in the whole of the image forming system 1.

The square folding process is started in synchronization with the conveyance of the booklet, produced by the booklet producing unit 7, to the square folding device 9. When the square folding process is started, the clamping jaw 91 clamps the booklet (Step S11).

Then, the roller 93 is moved along the back of the booklet while abutting on the back of the booklet (Step S12). The roller 93 switches the flattening mode in each one booklet, and the roller 93 is moved according to the switched mode.

When the movement of the roller 93 is ended, the clamping jaw 91 releases the clamping of the booklet (Step S13), and the carry-out roller 95 carries out the booklet to the stacker (Step S14). Thus, the square folding process is completed for one booklet.

Figure 14:
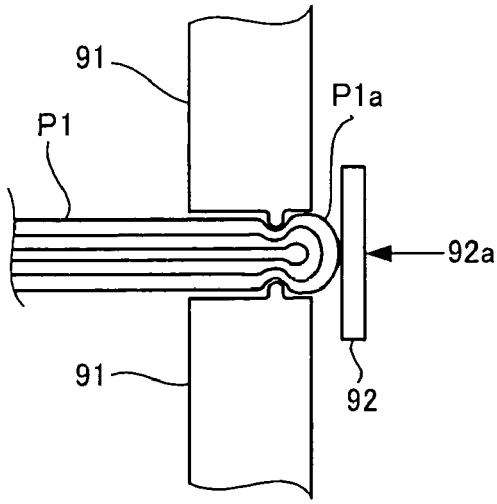
FIG. 14 shows a state of a square folding device in each process of the square folding process.
Figure 15:
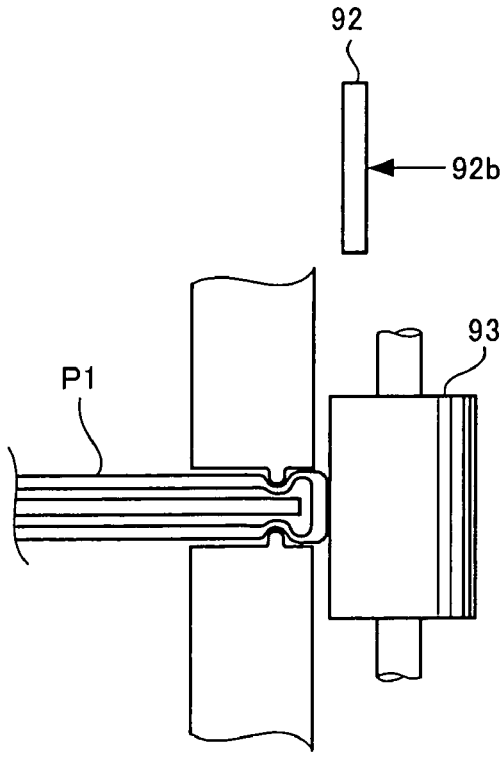
FIG. 15 shows a state of the square folding device in each process of the square folding process.
Figure 16:
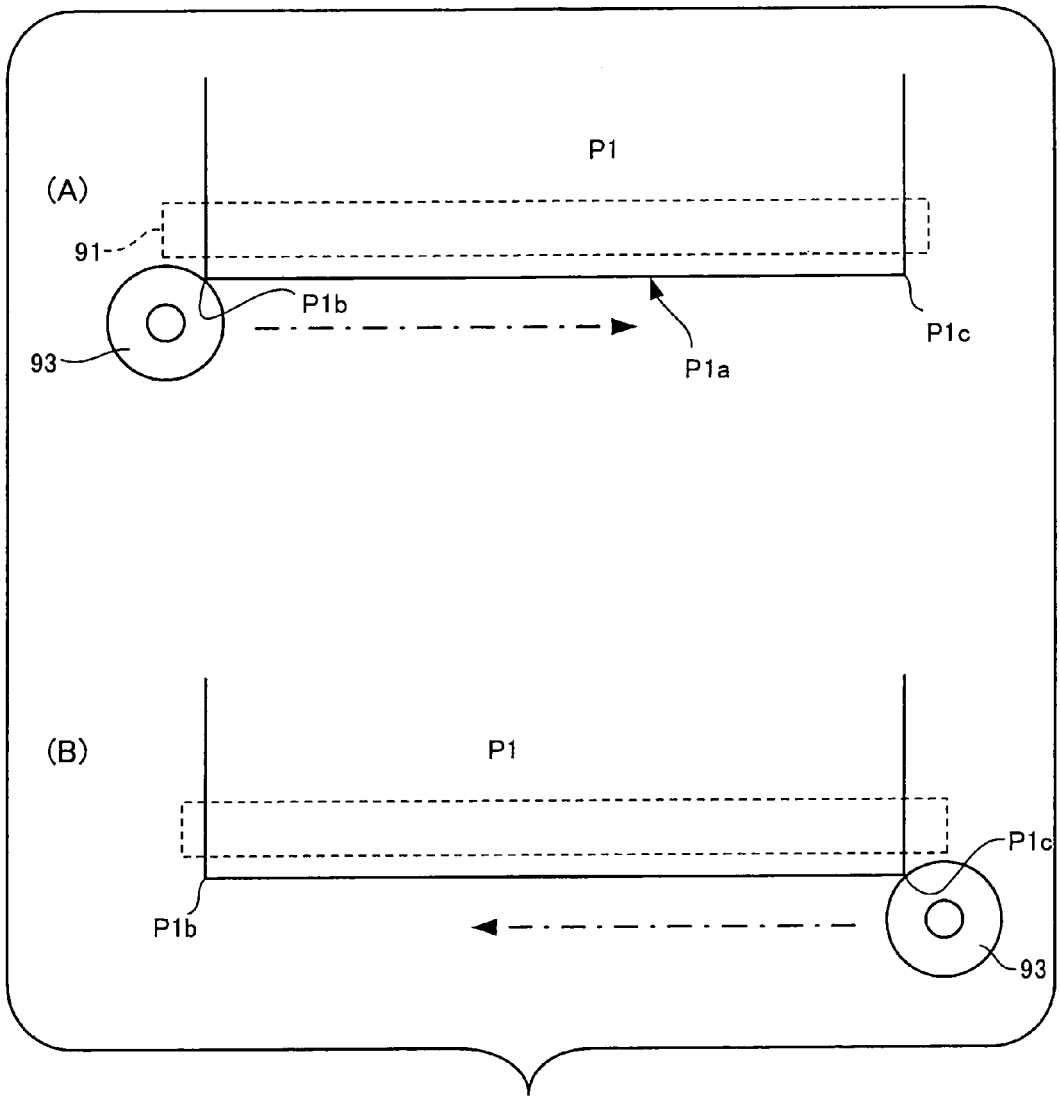
FIG. 16 shows a state of the square folding device in each process of the square folding process.

FIGS. 14, 15, and 16 show a state of the square folding device in each process of the square folding process.

The booklet P1 is produced by the booklet producing unit 7, and the booklet P1 passes through the trimming machine 8. Then, the booklet P1 is conveyed to the square folding device 9 while the back of the booklet P1*a* is set at the front end. At this point, because the stop plate 92 is located at a position 92*a* where the stop plate 92 closes the conveyance path of the booklet P1, the conveyed booklet P1 abuts on the stop plate 92. Therefore, the booklet P1 is positioned.

Then, as shown in FIG. 14, the pair of clamping jaws 91 clamps the booklet P1 positioned by the stop plate 92 from the both cover sides. At this point, the clamping jaw 91 and the stop plate 92 located at the position 92*a* where the stop plate 92 closes the conveyance path of the booklet P1 are arranged with a predetermined gap in the direction in which the booklet P1 is conveyed. Therefore, the back of the booklet P1*a* is projected from the clamping jaw 91 according to the gap between the stop plate 92 and the clamping jaw 91, which allows the clamping jaw 91 to clamp the booklet P1 while avoiding the back of the booklet P1*a*.

As shown in FIG. 15, the stop plate 92 is moved to a position 92*b* where the stop plate 92 is retracted from the conveyance pass of the booklet P1. Then, the roller 93 presses and abuts on the back of the booklet P1*a* of the booklet P1 clamped by the clamping jaw 91 with the force enough to press the back of the booklet P1*a*, and the roller 93 is moved along the back of the booklet P1*a* while abutting on the back of the booklet P1*a*. Therefore, the back of the booklet P1*a* is pressed and flattened.

As shown in FIG. 16, there are two flattening modes in the movement of the roller 93. In a first mode (A) of FIG. 16, the roller 93 is moved from a first end P1*b* which is of one end of the back of the booklet P1*a* to a second end P1*c* which is of the other end. This enables the back of the booklet P1*a* to be pressed from the first end P1*b* to the second end P1*c*. On the other hand, in a second mode (B) of FIG. 16, the roller 93 is moved in the direction opposite to the movement direction of the first mode, namely the roller 93 is moved from the second end P1*c* to the first end P1*b*. This enables the back of the booklet P1*a* to be pressed from the second end P1*c* to the first end P1*b*. Thus, the first mode differs from the second mode in the movement direction of the roller 93. The plural booklets are sequentially conveyed to the square folding device 9, and the roller 93 performs the flattening while switching between the first mode and the second mode in each one booklet.

Figure 17:
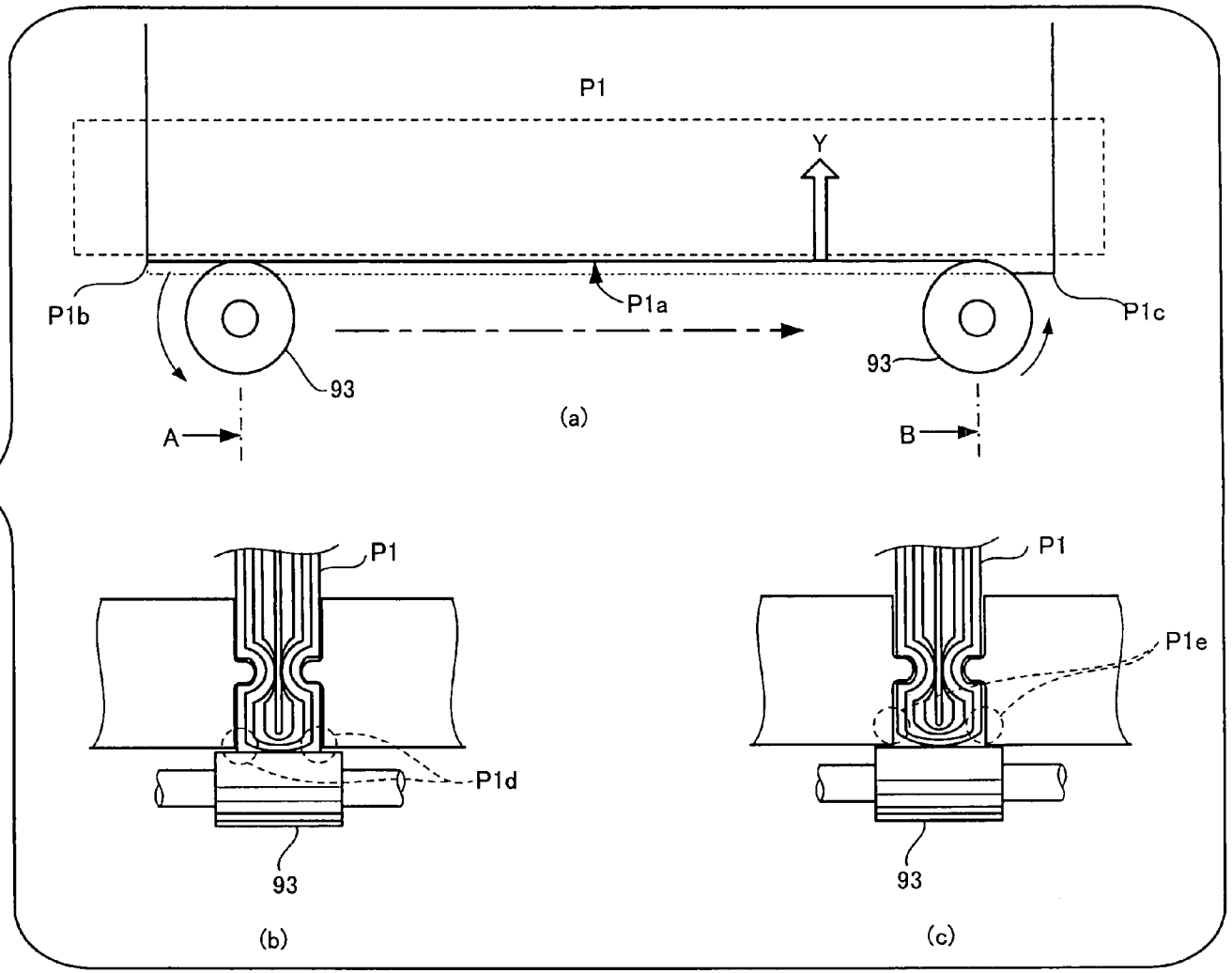
FIG. 17 shows a state in which a back portion of a booklet is flattened with movement of a roller.

FIG. 17 shows a state in which the back portion of the booklet is flattened with the movement of the roller 93.

Part (a) of FIG. 17 shows a position A immediately after the roller 93 starts to press the back of the booklet from the first end P1*b* of the back of the booklet P1*a* and a position B immediately before the roller 93 ends to press the back of the booklet at the second end P1*c*. Parts (b) and (c) of FIG. 17 show the cross sections of the booklet P1 at the positions A and B shown in part (a) respectively.

The back of the booklet P1*a* is projected from the clamping jaw 91 according to the gap between the stop plate 92 and the clamping jaw 91 at the position A immediately after the roller 93 starts to press the back of the booklet from the first end P1*b* of the back of the booklet P1*a*, which allows the roller 93 to press the back of the booklet P1*a* by the portion projected from the clamping jaw 91. As shown in part (b) of FIG. 17, at the position A, the back of the booklet P1*a* is strongly pressed so as to have a corner P1*d*, and the back of the booklet P1*a* is sufficiently flattened.

However, as the roller 93 is moved along the back of the booklet P1*a*, force with which the roller 93 presses and abuts on the back of the booklet P1*a* gradually shifts the booklet P1 toward a direction Y of the force. Because the fixing of the booklet P1 is kept only by the clamping of the clamping jaw 91, it is difficult to completely prevent the shift of the booklet P1. Accordingly, at the position B immediately before the roller 93 ends to press the back of the booklet at the second end P1*c*, the back of the booklet P1*a* is pushed into the clamping jaw 91 when viewed from the position of the roller 93, and the back of the booklet P1*a* escapes from the roller 93, which causes the roller 93 to slightly press the back of the booklet P1*a*. As shown in part (c) of FIG. 17, at the position B, the back of the booklet P1*a* keeps a curved surface P1*e*, and the flattening is not sufficiently performed.

As a result, in the portion of the booklet P1 where the roller 93 starts to press the back of the booklet P1*a*, there is a small tendency to open the booklet P1 after the square folding process, and the booklet thickness is thin. On the other hand, in the portion of the booklet P1 immediately before the roller 93 ends to press the back of the booklet P1*a*, there is a large tendency to open the booklet P1 after the square folding process, and the booklet thickness is thick. Thus, the bias is generated in the thickness of the booklet P1, and the thickness of the booklet P1 is gradually increased from the first end P1*b* toward the second end P1*c*.

In the square folding device 9 of the third exemplary embodiment, the roller 93 performs the flattening while switching between the first mode and the second mode in each one booklet. That is, the plural booklets are sequentially conveyed to the square folding device 9, and the movement direction of the roller 93 is switched in each booklet. According to the square folding device 9 of the third exemplary embodiment, the booklet in which the thickness on the side the first end P1*b* is larger than that on the side of the second end P1*c* and the booklet in which the thickness on the side the first end P1*b* is smaller than that on the side of the second end P1*c* are alternately finished.

Figure 18:
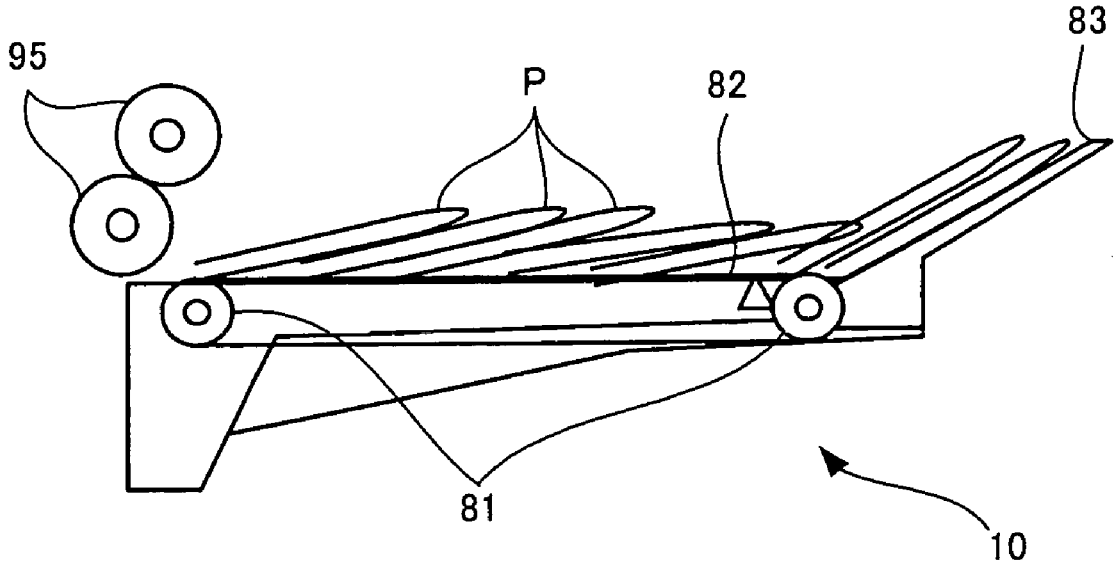
FIG. 18 shows a state in which plural booklets to which the square folding process is already performed are loaded on a stacker.

FIG. 18 shows a state in which the plural booklets to which the square folding process is already performed are loaded on the stacker.

The plural booklets to which the square folding process is performed are carried out onto the stacker 9 from the carry-out roller 95 of the square folding device 9. In the stacker 9, a conveyance belt 82 is stretched and supported by two drive rollers 81. The conveyance belt 82 is intermittently moved in each time when the booklet is carried out from the carry-out roller 95, which allows the conveyance belt 82 to convey the booklets P while the booklets P overlap one another. A loading tray 83 is provided at a front end in the conveyance direction of the conveyance belt 82. The first booklet conveyed by the conveyance belt 82 is raised along a loading tray 83 while loaded on the loading tray 83 so as to run on the loading tray 83. The booklets subsequent to the first booklet are raised along the previously conveyed booklet while loaded on the previously conveyed booklet so as to run on the previously conveyed booklet. Thus, the booklet conveyed by the conveyance belt 82 is raised by regulating the movement of the booklet with the loading tray 83, and the raised booklet is sequentially loaded while supported by the conveyance belt 82.

Figure 19:
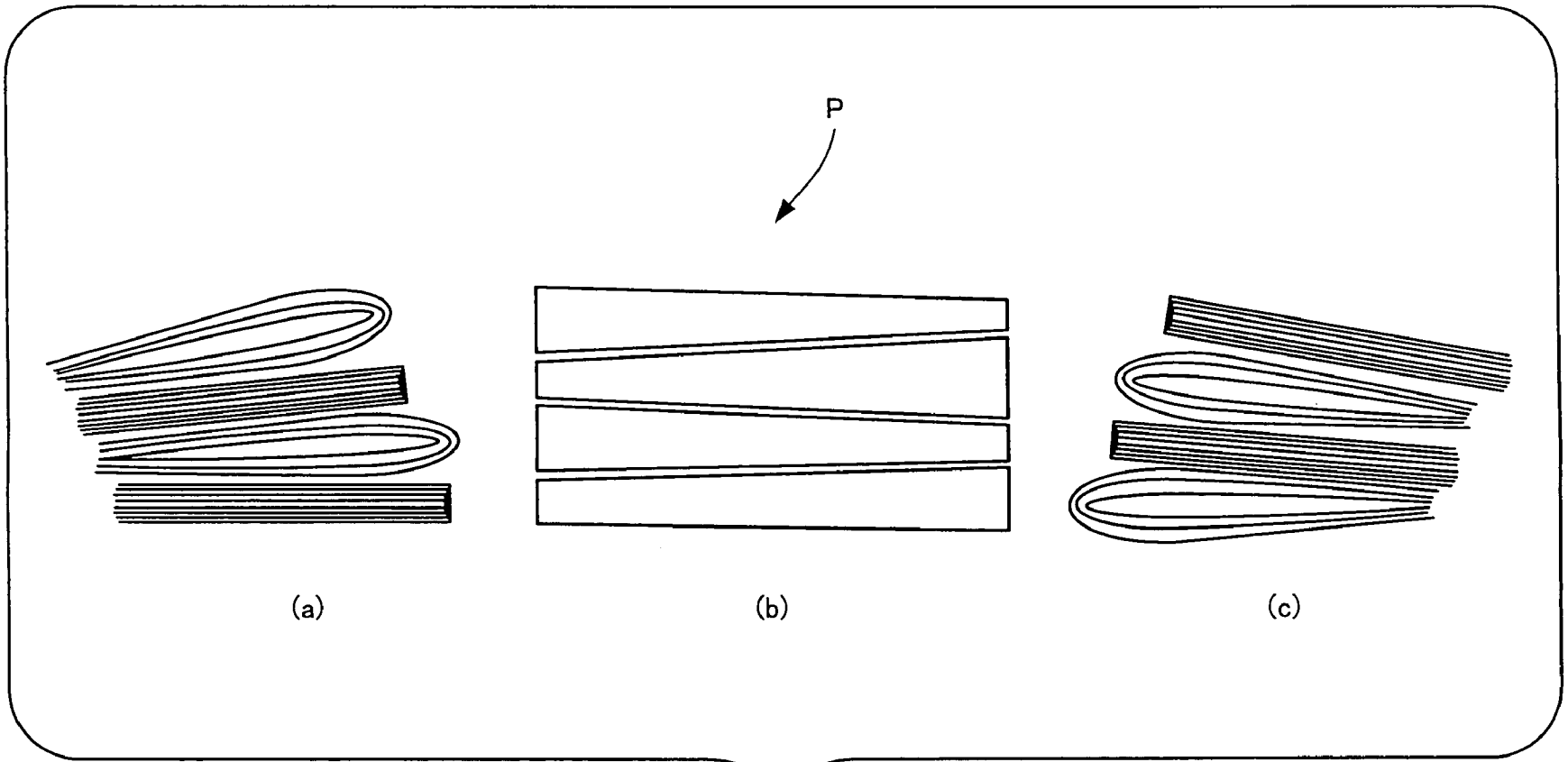
FIG. 19 shows a state in which the plural booklets whose back portions are flattened are loaded while overlapping one another.
Figure 20:
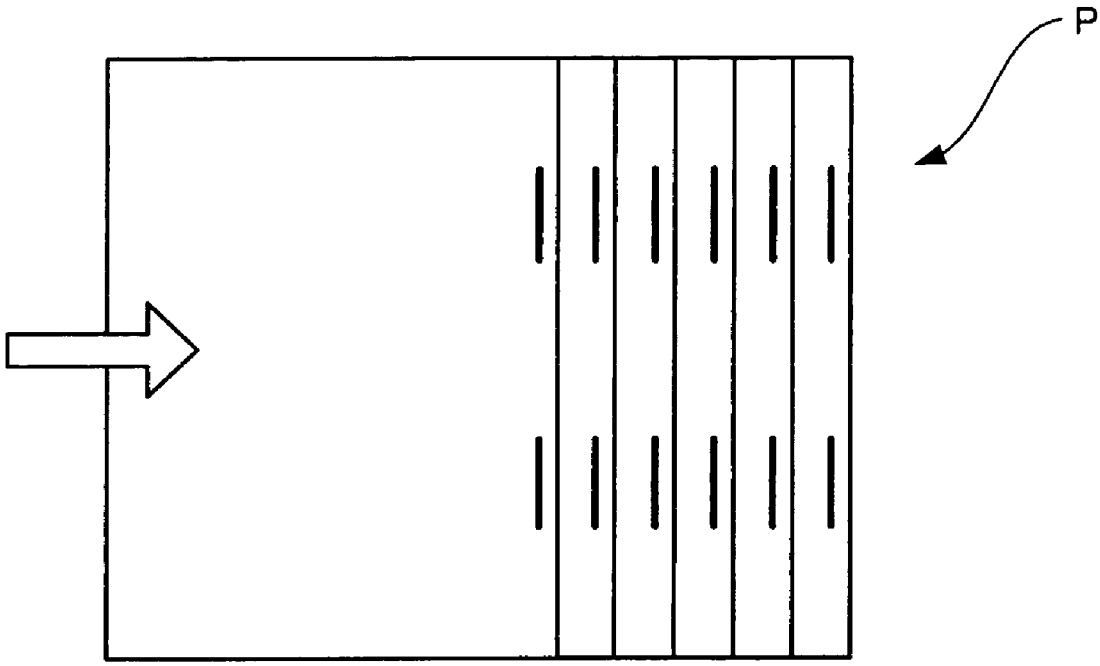
FIG. 20 shows a state in which the plural booklets whose back portions are flattened are loaded while overlapping one another.
Figure 21:
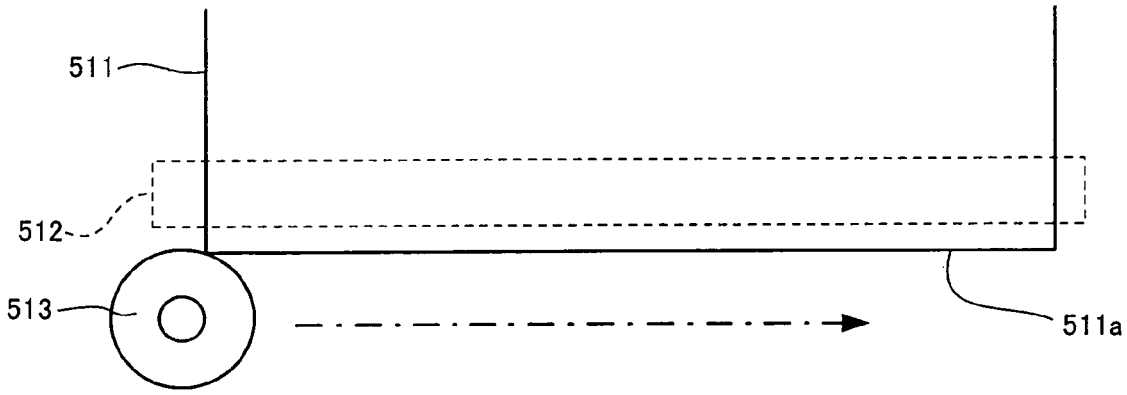
FIG. 21 shows a principle in which the back portion of the booklet is flattened by a conventional technique.

FIGS. 19 and 20 show a state in which the plural booklets whose back portions are flattened by the square folding device 9 are loaded while overlapping one another.

Part (b) of FIG. 19 shows the booklets P loaded on the stacker 9 when viewed from the back portion, and part (a) and part (c) show the booklets P when viewed from the left side and the right side respectively. FIG. 19 shows the booklets P loaded on the stacker 9 when viewed from the side. As shown in FIG. 19, each booklets P loaded on the stacker 9 has the bias in the thickness. However, in the booklets loaded on the stacker 10, the directions in which the thicknesses are increased are alternately inverted, so that the biases of the booklet thickness are balanced out by the overlapped booklets. Accordingly, the alignment state is kept well as shown in FIG. 20, and the drop-out and the fly-out of the booklet are suppressed, so that the large number of booklets can be loaded.

In the third exemplary embodiment, the roller 93 performs the flattening while switching between the first mode and the second mode in each conveyed booklet. However, the forming unit of the invention is not limited to the third exemplary embodiment. For example, the roller 93 may switch between the first mode and the second mode in each at least two booklets. However, in the case where the roller 93 switches the modes in each booklet, the effect of the invention is further enhanced because the alignment state of the booklets is kept better.

In the third exemplary embodiment, the roller 93 of the square folding device 9 is moved in parallel with the back of the booklet P1*a*. However, the invention is not limited to the third exemplary embodiment. For example, in the forming unit of the invention, a wide roller may be moved in an oblique direction with respect to the back of the booklet to shorten the movement distance of the roller.

In the third exemplary embodiments, the roller 93 is moved along the back of the booklet. However, the invention is not limited to the third exemplary embodiment, but any forming unit is used as long as the forming unit breaks down the back along the back of the booklet. For example, the roller may be fixed while the booklet may be moved.

In the third exemplary embodiment, the roller 93 is formed in the cylindrical shape. However, the invention is not limited to the third exemplary embodiment. For example, the forming unit may be a roller formed in a truncated cone or in the shape in which the truncated cones are combined.

In the third exemplary embodiment, the clamping jaw 91 clamps the booklet from the both cover sides. However, the invention is not limited to the third exemplary embodiment. For example, the clamping unit may be two rollers clamping the booklet. In the third exemplary embodiment, the pair of clamping jaws 91 is used. However, the invention is not limited to the third exemplary embodiment. For example, the booklet may be clamped by plural pairs of members.

In the third exemplary embodiment, the stacker 10 includes the belt for conveying the booklet, and various modes can be adopted in the booklet loading unit on which the booklets are loaded. For example, the booklet loading unit may include only the tray without the belt to put the booklet one on top of the other on the tray. The portion where the booklet runs on and the portion where the booklet is conveyed may integrally be moved. For the booklet loading device, the booklets are not loaded while raised, but the booklets may be loaded while laid down.

In the third exemplary embodiment, the stacker 10 loads the booklet without rotating an attitude of the carried-out booklet. However, in order to avoid the state in which the booklets overlap one another while the backs of the booklet are aligned with one another, the booklet loading unit which loads the booklets while alternately changing the attitudes of the booklets may be adopted such that the back of the booklet and the edge alternately overlap each other. In this case, the roller 93 switches between the first mode and the second mode in each at least two booklets.

In the third exemplary embodiment, the control circuit 26 is incorporated into the image forming apparatus 2. However, the invention is not limited to the third exemplary embodiment. For example, the control circuit may be mounted on the square folding device.

What is claimed is:

1. A booklet finishing apparatus comprising:

a clamping unit that flattens a booklet of folded sheets by clamping at least on portions adjacent to a back of the booklet from both surfaces of the booklet;

a forming unit that flattens the back of the booklet by pressing the back of the booklet; and a switching unit that has a plurality of modes to control the forming unit and switches for the booklet individually between the plurality of modes, the plurality of modes being based on any of information on content sheet thickness, information on cover indicating presence or absence of cover, information on saddle stitching indicating presence or absence of saddle stitching, or information on cover thickness, wherein the plurality of modes include a first mode and a second mode, and the switching unit switches between the first mode and the second mode;

in the first mode, the clamping unit clamps the booklet to flatten the booklet and the forming unit presses the back of the booklet to flatten the back of the booklet, in the second mode, the clamping unit clamps the booklet to flatten the booklet and the forming unit is stopped, and the switching unit obtains the information on cover indicating presence or absence of cover, and the switching unit switches between the first mode and the second mode according to the obtained information on cover indicating presence or absence of cover.

2. A booklet finishing apparatus comprising:

a clamping unit that flattens a booklet of folded sheets by clamping at least on portions adjacent to a back of the booklet from both surfaces of the booklet;

a forming unit that flattens the back of the booklet by pressing the back of the booklet; and a switching unit that has a plurality of modes to control the forming unit and switches between the plurality of modes, wherein the plurality of modes include a first execution mode and a second execution mode, and the switching unit alternates for the booklet individually between the first execution mode and the second execution mode for successive booklets; and in the first execution mode, the forming unit flattens the back of the booklet by pressing along the back of the booklet only in a direction from one end to the other end of the booklet, in the second execution mode, the forming unit flattens the back of the booklet by pressing along the back of the booklet only in a direction opposite to the direction in the first execution mode.

3. A post-treatment apparatus comprising:

a booklet producing unit that produces a booklet by collecting and folding sheets;

a clamping unit that flattens the produced booklet by clamping at least on portions adjacent to a back of the booklet from both surfaces of the booklet;

a forming unit that flattens the back of the booklet by pressing the back of the booklet; and a switching unit that has a plurality of modes to control the forming unit and switches for the booklet individually between the plurality of modes, the plurality of modes being based on any of information on content sheet thickness, information on cover indicating presence or absence of cover, information on saddle stitching indicating presence or absence of saddle stitching, or information on cover thickness, wherein the plurality of modes include a first mode and a second mode, and the switching unit switches between the first mode and the second mode;

in the first mode, the clamping unit clamps the booklet to flatten the booklet and the forming unit presses the back of the booklet to flatten the back of the booklet, in the second mode, the clamping unit clamps the booklet to flatten the booklet and the forming unit is stopped, and the switching unit obtains the information on cover indicating presence or absence of cover, and the switching unit switches between the first mode and the second mode according to the obtained information on cover indicating presence or absence of cover.

4. A post-treatment apparatus comprising:

a booklet producing unit that produces a booklet by collecting and folding sheets;

a clamping unit that flattens the produced booklet by clamping at least on portions adjacent to a back of the booklet from both surfaces of the booklet;

a forming unit that flattens the back of the booklet by pressing the back of the booklet; and a switching unit that has a plurality of modes to control the forming unit and switches for the booklet individually between the plurality of modes, wherein the plurality of modes include a first execution mode and a second execution mode, and the switching unit alternates between the first execution mode and the second execution mode for successive booklets; and in the first execution mode, the forming unit flattens the back of the booklet by pressing along the back of the booklet only in a direction from one end to the other end of the booklet, in the second execution mode, the forming unit flattens the back of the booklet by pressing along the back of the booklet only in a direction opposite to the direction in the first execution mode.

5. An image forming system comprising:

an image forming unit that forms an image on a sheet;

a booklet producing unit that produces a booklet by collecting and folding the sheet that the image is formed on;

a clamping unit that flattens the produced booklet by clamping at least on portions adjacent to a back of the booklet from both surfaces of the booklet;

a forming unit that flattens the back of the booklet by pressing the back of the booklet; and a switching unit that has a plurality of modes to control the forming unit and switches for the booklet individually between the plurality of modes, the plurality of modes being based on any of information on content sheet thickness, information on cover indicating presence or absence of cover, information on saddle stitching indicating presence or absence of saddle stitching, or information on cover thickness, wherein the plurality of modes include a first mode and a second mode, and the switching unit switches between the first mode and the second mode;

in the first mode, the clamping unit clamps the booklet to flatten the booklet and the forming unit presses the back of the booklet to flatten the back of the booklet, in the second mode, the clamping unit clamps the booklet to flatten the booklet and the forming unit is stopped, and the switching unit obtains the information on cover indicating presence or absence of cover, and the switching unit switches between the first mode and the second mode according to the obtained information on cover indicating presence or absence of cover.

6. An image forming system comprising:

an image forming unit that forms an image on a sheet;

a booklet producing unit that produces a booklet by collecting and folding the sheet that the image is formed on;

a clamping unit that flattens the produced booklet by clamping at least on portions adjacent to a back of the booklet from both surfaces of the booklet;

a forming unit that flattens the back of the booklet by pressing the back of the booklet; and a switching unit that has a plurality of modes to control the forming unit and switches for the booklet individually between the plurality of modes, wherein the plurality of modes include a first execution mode and a second execution mode, and the switching unit alternates between the first execution mode and the second execution mode for successive booklets; and in the first execution mode, the forming unit flattens the back of the booklet by pressing along the back of the booklet only in a direction from one end to the other end of the booklet, in the second execution mode, the forming unit flattens the back of the booklet by pressing along the back of the booklet only in a direction opposite to the direction in the first execution mode.

7. A booklet finishing apparatus comprising:

a clamping unit that flattens a booklet of folded sheets by clamping at least on portions adjacent to a back of the booklet from both surfaces of the booklet;

a forming unit that flattens the back of the booklet by pressing the back of the booklet; and a switching unit that has a plurality of modes to control the forming unit and switches for the booklet individually between the plurality of modes, the plurality of modes being based on any of information on content sheet thickness, information on cover indicating presence or absence of cover, information on saddle stitching indicating presence or absence of saddle stitching, or information on cover thickness, wherein the plurality of modes include a first mode and a second mode, and the switching unit switches between the first mode and the second mode, in the first mode, the clamping unit clamps the booklet to flatten the booklet and the forming unit presses the back of the booklet to flatten the back of the booklet, in the second mode, the clamping unit clamps the booklet to flatten the booklet and the forming unit is stopped, and the switching unit obtains the information on cover thickness, and the switching unit switches between the first mode and the second mode according to the obtained information on cover thickness.

8. A post-treatment apparatus comprising:

a booklet producing unit that produces a booklet by collecting and folding sheets:

a clamping unit that flattens the produced booklet by clamping at least on portions adjacent to a back of the booklet from both surfaces of the booklet;

a forming unit that flattens the back of the booklet by pressing the back of the booklet; and a switching unit that has a plurality of modes to control the forming unit and switches for the booklet individually between the plurality of modes, the plurality of modes being based on any of information on content sheet thickness, information on cover indicating presence or absence of cover, information on saddle stitching indicating presence or absence of saddle stitching, or information on cover thickness, wherein the plurality of modes include a first mode and a second mode, and the switching unit switches between the first mode and the second mode;

in the first mode, the clamping unit clamps the booklet to flatten the booklet and the forming unit presses the back of the booklet to flatten the back of the booklet, in the second mode, the clamping unit clamps the booklet to flatten the booklet and the forming unit is stopped, and the switching unit obtains the information on cover thickness, and the switching unit switches between the first mode and the second mode according to the obtained information on cover thickness.

9. An image forming system comprising:

an image forming unit that forms an image on a sheet;

a booklet producing unit that produces a booklet by collecting and folding the sheet that the image is formed on, a clamping unit that flattens the produced booklet by clamping at least on portions adjacent to a back of the booklet from both surfaces of the booklet, a forming unit that flattens the back of the booklet by pressing the back of the booklet, and a switching unit that has a plurality of modes to control the forming unit and switches for the booklet individually between the plurality of modes, the plurality of modes being based on any of information on content sheet thickness, information on cover indicating presence or absence of cover, information on saddle stitching indicating presence or absence of saddle stitching, or information on cover thickness, wherein the plurality of modes include a first mode and a second mode, and the switching unit switches between the first mode and the second mode, in the first mode, the clamping unit clamps the booklet to flatten the booklet and the forming unit presses the back of the booklet to flatten the back of the booklet, in the second mode, the clamping unit clamps the booklet to flatten the booklet and the forming unit is stopped, and the switching unit obtains the information on cover thickness, and the switching unit switches between the first mode and the second mode according to the obtained information on cover thickness.

* * * * *